US009874098B2

(12) United States Patent
Libralato

(10) Patent No.: US 9,874,098 B2
(45) Date of Patent: Jan. 23, 2018

(54) IGNITION ENGINE OF THE ROTARY TYPE WITH A DOUBLE ROTATION CENTER

(71) Applicant: Libralato Ltd., Manchester (GB)

(72) Inventor: Ruggero Libralato, Belluno (IT)

(73) Assignee: LIBRALATO LTD., Manchester (GB)

( * ) Notice: Subject to any disclaimer, the term of this patent is extended or adjusted under 35 U.S.C. 154(b) by 241 days.

(21) Appl. No.: 14/648,415

(22) PCT Filed: Dec. 2, 2013

(86) PCT No.: PCT/EP2013/075273
§ 371 (c)(1),
(2) Date: May 29, 2015

(87) PCT Pub. No.: WO2014/083204
PCT Pub. Date: Jun. 5, 2014

(65) Prior Publication Data

US 2015/0300173 A1 Oct. 22, 2015

(30) Foreign Application Priority Data

Nov. 30, 2012 (IT) ..... BL2012A0010

(51) Int. Cl.
*F02B 53/00* (2006.01)
*F01C 1/44* (2006.01)
(Continued)

(52) U.S. Cl.
CPC ..... *F01C 21/18* (2013.01); *F01C 1/44* (2013.01); *F01C 19/02* (2013.01); *F01C 21/08* (2013.01);
(Continued)

(58) Field of Classification Search
CPC .. F01C 21/08; F01C 1/44; F01C 21/18; F01C 19/02; F02B 53/04; F02B 53/12; F04C 2250/20
(Continued)

(56) References Cited

U.S. PATENT DOCUMENTS 3,324,839 A 6/1967 Erwin
4,548,171 A 10/1985 Larson
5,752,806 A 5/1998 Frey et al.

FOREIGN PATENT DOCUMENTS

AT WO 2009036475 A1 * 3/2009 ..... F01C 1/44
DE 830440 2/1952
(Continued)

OTHER PUBLICATIONS

WIPO Search Report dated May 26, 2014 for International Publication No. WO 2014/083204.
(Continued)

*Primary Examiner* — Thai Ba Trieu
(74) *Attorney, Agent, or Firm* — The Dobrusin Law Firm, PC

(57) ABSTRACT

The present invention refers to a spark ignition engine of the rotary type with a double rotation center, comprising a stator (A) with a stator central body (A1) having a compartment (1, 2), a first side cover (A2) and a second side cover (A3), wherein the compartment includes an expansion compartment (1) and a compression compartment (2) and a combustion chamber at an upper portion of the compartment (1, 2), a rotor (B) with an expansion rotating element (B1), a compressing rotating element (B2) and a hinging linear element (B3) interposed between said expansion rotating element (B1) and the compression rotating element (B2), the rotor is arranged in the compartment (1, 2) of the stator central body, wherein the expansion compartment (1) com-
(Continued)

prises a concave inner surface (1*a*) and the compression compartment (2) comprises a convex inner surface (2*a*).

9 Claims, 21 Drawing Sheets

(51) Int. Cl.

| | |
|---|---|
| ***F01C 21/18*** | (2006.01) |
| ***F01C 19/02*** | (2006.01) |
| ***F01C 21/08*** | (2006.01) |
| ***F02B 53/04*** | (2006.01) |
| ***F02B 53/12*** | (2006.01) |

(52) U.S. Cl.
CPC ..... *F02B 53/04* (2013.01); *F02B 53/12* (2013.01); *F04C 2250/20* (2013.01)

(58) Field of Classification Search
USPC ..... 123/241
IPC ..... F01C 1/44
See application file for complete search history.

(56) References Cited

FOREIGN PATENT DOCUMENTS

| | | | | |
|---|---|---|---|---|
| DE | 2338962 | | 2/1975 | |
| DE | 4424626 | A1 * | 1/1996 | ..... F01C 1/44 |
| EP | 1540139 | | 11/2013 | |
| GB | 2083557 | A * | 3/1982 | ..... F01C 1/44 |
| IT | BL910009 | B | 5/1992 | |
| JP | S60-132030 | A | 7/1985 | |
| JP | S62-502205 | A | 8/1987 | |
| WO | 2004/020791 | | 3/2004 | |
| WO | 2010/031585 | | 6/2014 | |

OTHER PUBLICATIONS

Written Opinion of the ISA, PCT/EP2013/075273, filed Dec. 2, 2013.
Ministry of Economic Development Search Report completed Sep. 20, 2013 for Application No. BL20120010.
Japanese Office Action for Application No. 2015-544497, dated Sep. 29, 2017.

* cited by examiner

IGNITION ENGINE OF THE ROTARY TYPE WITH A DOUBLE ROTATION CENTER

CLAIM OF PRIORITY

The present application claims the benefit of the PCT Application PCT/EP2013/075273, filed Dec. 2, 2013 and Italian Application No. BL2012A000010, filed Nov. 30, 2012, the contents of which are hereby incorporated by reference in their entirety.

BACKGROUND OF THE INVENTION

The present application claims the benefit of the PCT Application PCT/EP2013/075273, filed Dec. 2, 2013 and Italian Application No. BL2012A000010, filed Nov. 30, 2012, the contents of which are hereby incorporated by reference in their entirety.

The invention relates to the implementation of a spark-ignition engine improved structure, of the rotary type and with double rotation centre of the rotating mass, with which improved mass one makes possible the optimization of the thermodynamic efficiency thereof, with decrease in the mechanical efforts the vibrations due to the accelerations and decelerations of the rotor thereof, apart from a simplification of the structure thereof and with the outlet separation of the burnt exhaust gases from the ones mixed with washing air, thus determining even the possibility of applying a catalytic muffler completing the efficiency thereof.

The main feature of the present invention is to provide the improvement of the rotary engine with double rotation centre, the outer side surface for sliding the rotating elements and the stator corresponding internal surface having a curved shape, so that, the overall dimensions and the power requested by the engine being equal, an ideal relationship between the volumes forming in the phases for sucking and compressing the combustion air can be obtained, with respect to the volumes of the burnt gases during the useful expansion phase and, for which ideal relationship, one makes possible to reduce to the minimum the wheelbase between the rotor compression and expansion elements, as well as the one of the corresponding stator-housing compartments, apart from allowing a different and separate discharge outlet of the combustion gases with respect to the washing ones of the same engine.

Several solutions of so-called "rotating piston" engines have been devised and implemented to overcome the inertia and overall dimension limits characterizing the current so-called "alternating piston" engines, among other things such solutions finding several structural and functional difficulties which up to now have limited the production on industrial scale thereof.

A good contribution to overcoming several of these problems was given by the patent EP 1.540.139—in the name of the applicant of the present application—which patent has improved and made more functional some previous solutions of rotary engine of the same applicant, already based upon two rotation centres of an element or rotating piston, by providing the implementation of a rotor constituted by two rotating elements which are made sliding therebetween by means of a third rotating element of mutual jointed junction, the rotor revolving within a seat, which is substantially constituted by two cylindrical compartments with approached axes and comprising an intermediate combustion chamber, to form predefined compartments which are apt to develop the various sucking, compression, combustion phases with expansion and gas discharge.

From the experience acquired with the implementation and structural improvement of the rotary engine according to the teaching the patent Nr. EP 1.540.139 it was possible obtaining an improved thermodynamic cycle of spark-ignition engine, still of the type with double rotation axis, which cycle and the structure thereof form the subject of the International patent application WO 2010/031585, still in the name of the same applicant.

In the patent application Nr. WO 2010/031585 in particular the object of implementing an improved thermodynamic cycle is achieved, in which cycle the engine allows mixing the air with the fuel directly within a compression department thereof, with consequent elimination of any possible loss of unburnt hydrocarbons, in particular during the phase of washing the expansion chamber, thus guaranteeing the complete combustion and obtaining the lowering of the environmental pollution, apart from increasing the yield of the combustion mixture and therefore of the mentioned type engine.

However, the practical implementation even of this improved solution of thermodynamic cycle and of the engine thereof of rotary type with double rotation centre, underlines the fact that optimal values of rotation speed result to be difficult to be obtained without an additional needed improvement of the structure thereof, in particular with strengthening the drive shaft and the supporting elements thereof, apart from with the implementation of particular structural expedients of the rotor elements and of the hinging linear element thereof, according to the teaching of the patent application Nr. BL2010A03, in the name of the same applicant of the present application. In the additional solution the space was created for applying the bearing liners on the compressing rotating element, with the possibility of slightly increasing the drive shaft diameter, and with the implementation of a dome in the spark-ignition engine, for a better gas turbulence in the ignition phase.

However, even these expedients did not eliminate completely other drawbacks which are of course present in a strongly innovative solution such as that implemented in the above-mentioned patent applications. In particular, the space availability between the drive shaft and the inner portion of the supporting rings of the compression rotor element resulted to be still poor, therefore the diameter of the shaft has remained still limited, by solving only partially the problem of the mechanical resistance thereof, with respect to the high power already obtainable in the rotor combustion and expansion phase.

Even the revolution number of such rotary engine has resulted to be still limited by the variation in the rotation speed of the compression element, due to the acceleration thereof in the phase of outgoing from the expansion element and deceleration thereof during the going-back phase. Such speed variation is always the cause of consistent mechanical efforts and vibrations of the engine, therefore the need of adopting a quite low rotation speed, with respect to the expressible power, is involved.

The thermodynamic yield of an engine is notoriously influenced by the useful or working surface, at the time of maximum pressure reached by the gases in the initial expansion phase thereof which, in the solution proposed with the mentioned application WO 2010/031585, is given by the plane surface and with rectangular shape represented by the plane head of the expansion element outgoing from the compression element. The rectangular plane surface allows forming a minimum surface for pushing frontally the rotor element, just at the initial expansion moment when the combustion energy is maximum.

According to the various known and above-specified solutions, the width of the two expansion and compression stator compartments is determined by the distance of the respective axes and by the different forming radius. In particular, the distance or wheelbase should be maximum, to obtain a higher engine capacity, but it should reduced be as much as, to give the maximum space to the drive shaft and to the rolling supports thereof. Furthermore, the minimum distance between the two axes would allow to reduce to the minimum the speed variations between the two rotor elements, by allowing thereto to reach a high rotation speed and power.

According to the above-mentioned technique, in a rotation speed of the drive shaft which is compatible with the power developed by a four-stroke rotary engine, the wheelbase between the stator's two cylindrical compartments must correspond approximately to a value equal to about 25% of the value average of the generating radii of the same compartments. Lower values of this wheelbase are acceptable but they reduce the volumes of the chambers and therefore the engine capacity, with a volume-surface ratio which is disadvantageous for the expansion chamber. Higher values of the same wheelbase involve excessive mechanical efforts for the same engine, caused by the acceleration and deceleration in the mutual sliding between the two expansion and compression elements of the rotor itself, apart from having the already mentioned greater structural, moving and tight difficulties and therefor currently only engines with low rotation speed are made possible.

At last, it has been found that in the same mentioned known solutions of rotary engine, the combustion gases result to be mixed with air already stored in the washing phase and containing oxygen, by making not compatible the use of catalytic mufflers and thus determining serious problems in lowering the pollutants contained in the exhaust gases.

SUMMARY OF THE INVENTION

The main object of what forms the subject of the present invention is in fact to be able to exploit at maximum the power obtainable with the engine of the mentioned type, by implementing the best ration between the compression and expansion volumes, substantially the overall dimensions and engine power being equal, even if the wheelbase between the rotating elements and then that between the containment stator compartments thereof is reduced to the minimum.

Within such object, another important object is to be able to exploit to the maximum the power which can be expressed by the engine of the mentioned type, by reducing to the minimum the difference in translation speed of the linear rotor element hinging the compression element with the expansion element, thus implementing a decrease in the mutual accelerations and decelerations, for which decrease even the increase in the engine number of revolutions is made possible.

An additional object of the present invention is to be able to have the maximum surface for pushing the expansion element, in particular in the moment immediately subsequent the combustion phase.

Still another object of the present invention is to be able to adopt a drive shaft having a diameter so as to exploit to the maximum the engine power, releasing the diameter from the overall dimensions of the mutual rotation of the compression and expansion elements and from the mutual distance or wheelbase thereof.

Another important object of the present invention is to be able to improve the arrangement and the housing of the oil retainer junctions or bearings or bearing linings between stator and rotor of the engine of the mentioned type, by having more space around the drive shaft at disposal and by determining even a better lubrication thereof.

Not last object of present invention is to be able to reduce to the minimum the polluting emission of the exhaust gases at the outlet thereof, by allowing to adopt even usual catalytic mufflers and therefore by improving the efficiency of the engine of the mentioned type.

These and other objects are in fact achieved with the endothermic rotary engine with double rotation centre forming the subject of the present invention, according to the enclosed main claim, which engine characterizes in that the outer side surface for sliding the rotor elements thereof and the corresponding inner surface of the stator have a curved shape thereof, so that, the overall dimensions and the power required to the engine being equal, an ideal relationship between the volumes forming in the phases for sucking and compressing the combustion air can be obtained, with respect to the expansion volumes of the burnt gases and, for which relationship, one makes possible to reduce to the minimum the wheelbase between the rotor compression and expansion elements and the one of the corresponding stator-housing compartments, apart from allowing a different and separate discharge outlet of the combustion gases with respect to the washing ones of the same engine.

BRIEF DESCRIPTION OF THE DRAWINGS

The proposed solution and the correspondence thereof with the above-specified objects, is better described and illustrated hereinafter, by way of example only and not with limitative purpose, even with the help of Nr. 20 schematic figures, reproduced in Nr.21 enclosed tables and wherein.

In all figures the same details are represented or are meant to be represented with the same reference number.

DETAILED DESCRIPTION

Figure 1:
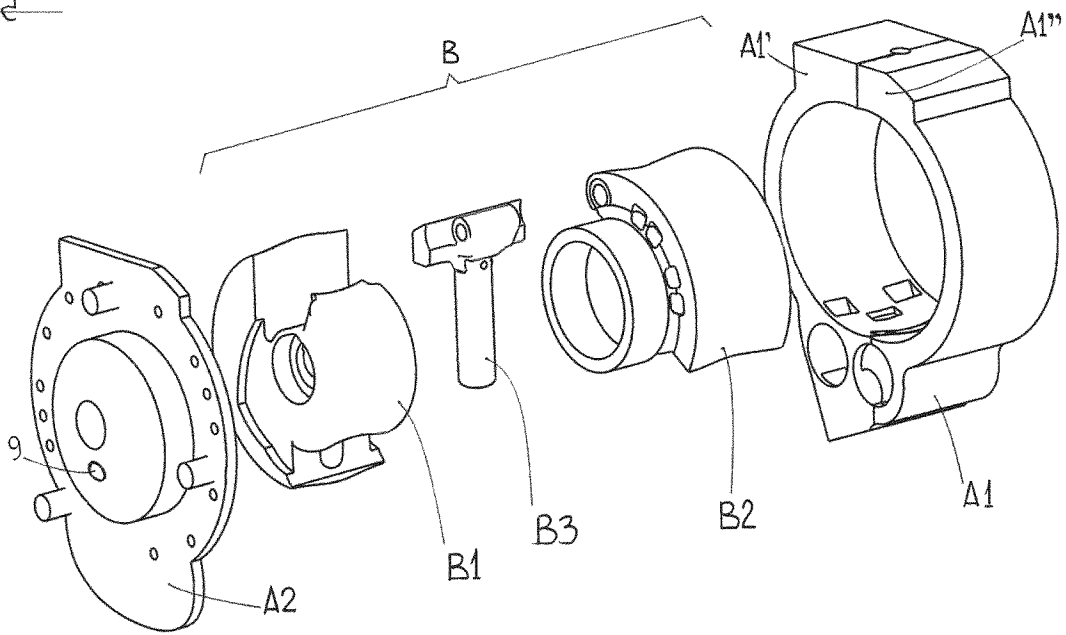
FIG. 1 represents the perspective and exploded view of some of the main portions of the improved engine, subject of the present invention.

By referring in particular to FIG. 1, according to the present invention, the improved rotary endothermic engine of the type with double rotation centre, is constituted by one stator or housing (A) which, in turn, comprises a stator central body (A1), a side cover (A2) and an analogous opposed, not represented cover (A3), apart from a rotor (B) which, in turn, comprises an expansion rotating element (B1), a compression rotating element (B2) and a hinging linear element (B3), interposed between the expansion (B1) an compression (B2) elements, the same elements being substantially devised according to the technique proposed with the already mentioned patent applications Nr. WO 2004/020791, Nr. WO 2010/031585 and Nr. BL2010A03, as better specified below.

Figure 6:
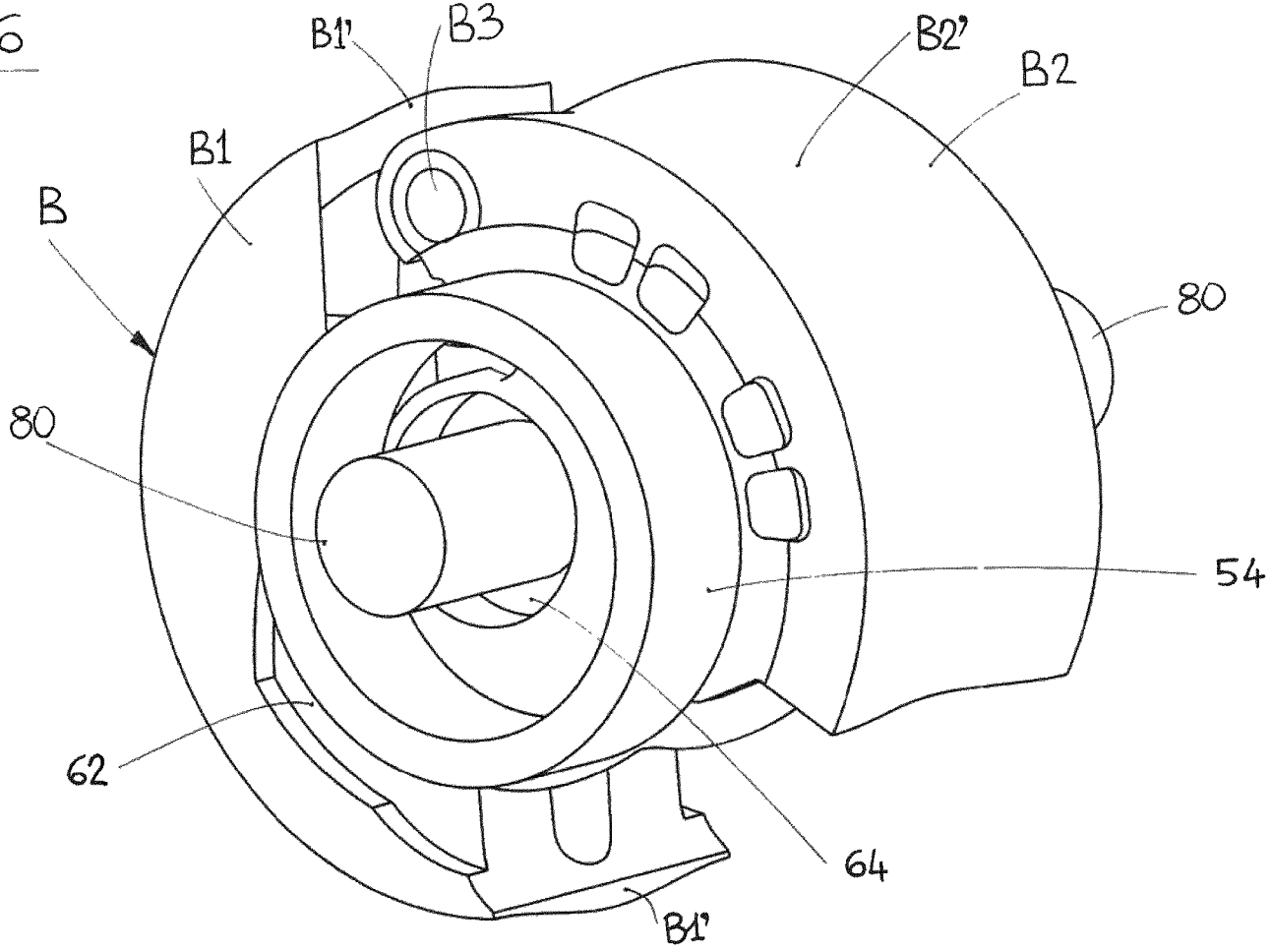
FIG. 6 represents a perspective view of the set of the rotor portions of the engine of FIG. 1, including the compression, expansion and mutual hinging elements thereof, such elements being represented under a random arrangement condition, with respect to the drive shaft.

For sake of representation simplicity, a drive shaft (80) has been represented only in FIG. 6, whereas in the other figures it has to be meant to be already present and connected in direct inlet with the expansion element (B1) which imparts the useful rotation. The drive shaft (80) is meant to be implemented substantially according to the mentioned patent application BL2010A03.

Figure 2:
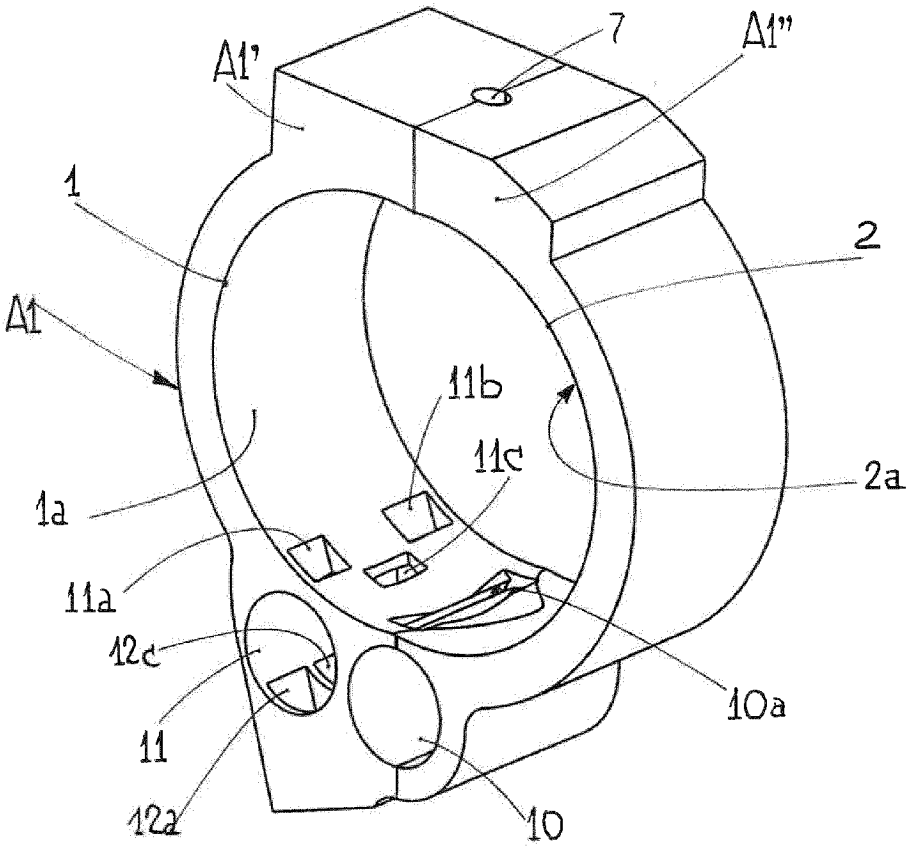
FIG. 2 represents a perspective view of the stator only of the engine of FIG. 1.

Still for sake of structural simplicity, the stator (A1) has generally been represented as one single body comprising the expansion (1) and compression (2) compartments, apart from the other elements specified hereinafter. To say the truth, according to a preferred solution, the stator (A1) can be implemented in two bodies (A1'-A1"), as exemplified only in the initial FIGS. 1-2 and in the final FIGS. 19 and 20. From such figures, it can be understood that, according to the solution, the junction between the stator bodies (A1'-A1") preferably is implemented along the profile of the intersection between the cavity (1*a*) existing in the compartment (1) and the convexity (2*a*) existing in the compartment (2) of the same stator (A1), as better specified hereinafter. Of course, the perfect junction between the bodies (A1') and (A1") of the stator (A1) will be guaranteed by a determined number of tie rods, according to the known art.

In the same FIG. 6, then, one of the tracks (54) for sliding the compression element (B2) on the respective stator cover (A2) is represented, as it is represented the passage hole (64) of the drive shaft (80) in the same element (B2) and as it is represented the lowering (62) existing on the sides of the expansion element (B1), substantially according to the teaching of the mentioned patent EP 1.154.139.

By referring to FIGS. 2-3-4 and 5, the central body (A1) of the stator (A) is equipped with an approximately half-cylindrical compartment (1) with concave surface (1*a*) which is mainly destined to the phase for expanding the burnt gases, and an opposed approximately half-cylindrical compartment (2) with convex surface (2*a*), which is mainly destined to the phases for sucking and compressing the combustion air.

The compartments (1-2) are arranged along a cross plane (z) and they are intersecting therebetween along the orthogonal planes (x-y), which are spaced out by a value (s), better specified hereinafter.

At the higher intersection between the compartments (1 and 2) but substantially all comprised in the compartment (2), a combustion chamber (8) is arranged, which is connected to a duct (7) for housing a spark plug or an injector, to determine the spark of the phase for igniting the combustion mixture within the chamber (8).

Approximately at the lower intersection between the compartments (1-2) of the stator (A1) but mainly in proximity of the compartment (1), the cylindrical seats (10-11) are arranged, respectively destined to house the sucking valve (100) and the discharging valve (110), as better specified hereinafter. The sucking seat (10) communicates with the compartments (1-2) of the stator (a1) by means of a slot (10*a*) extending for a good portion of the width of the same stator (A1). The discharge seat (11) has two side upper ducts (11*a*-11*b*) and a central duct (11*c*) communicating with the expansion compartment (1) of the stator (A1), however the central duct (11*c*) being displaced by some degrees towards the intersection point of the vertical plane (x).

Figure 3:
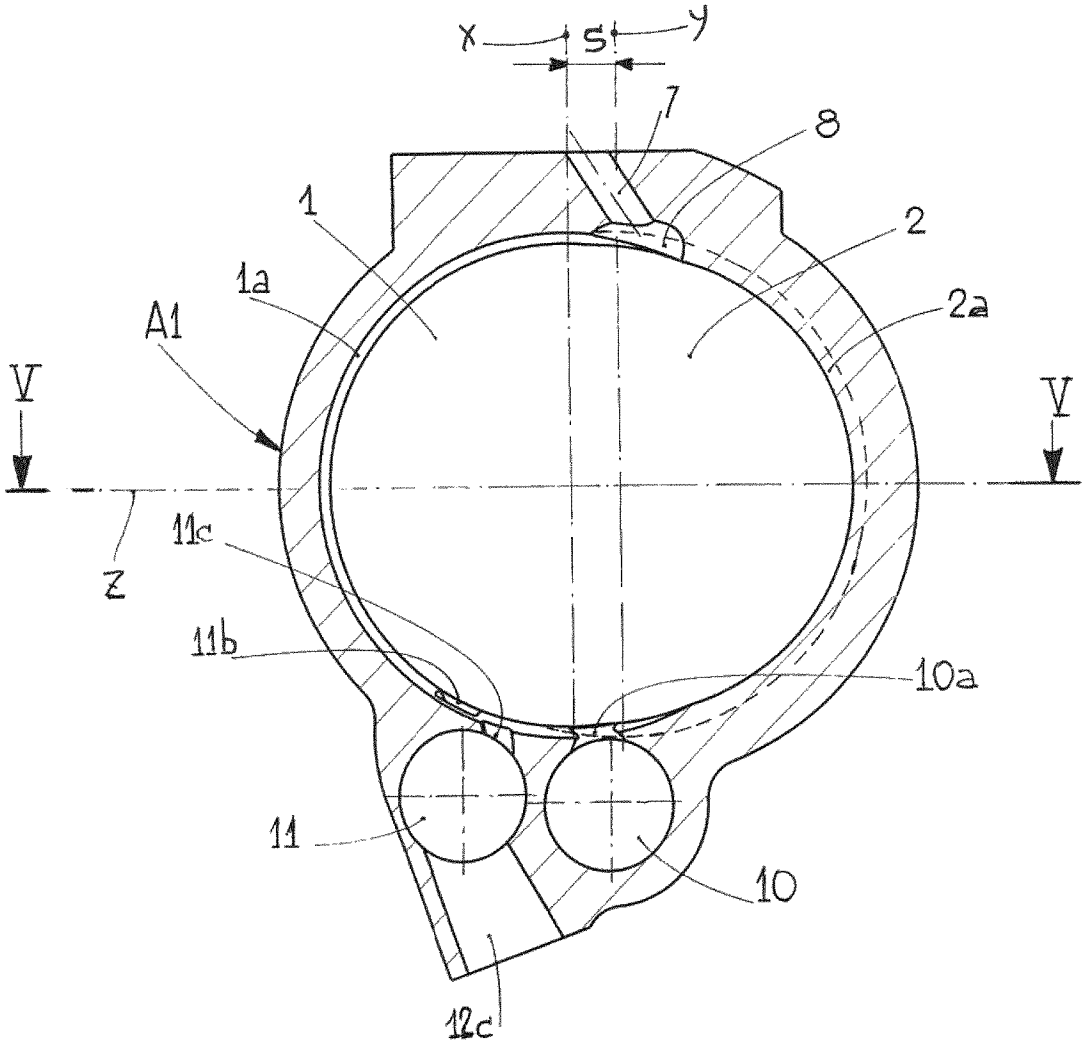
FIG. 3 represents an intermediate vertical section view of the stator of FIG. 2, according to the plane of section III-III of FIG. 5.
Figure 4:
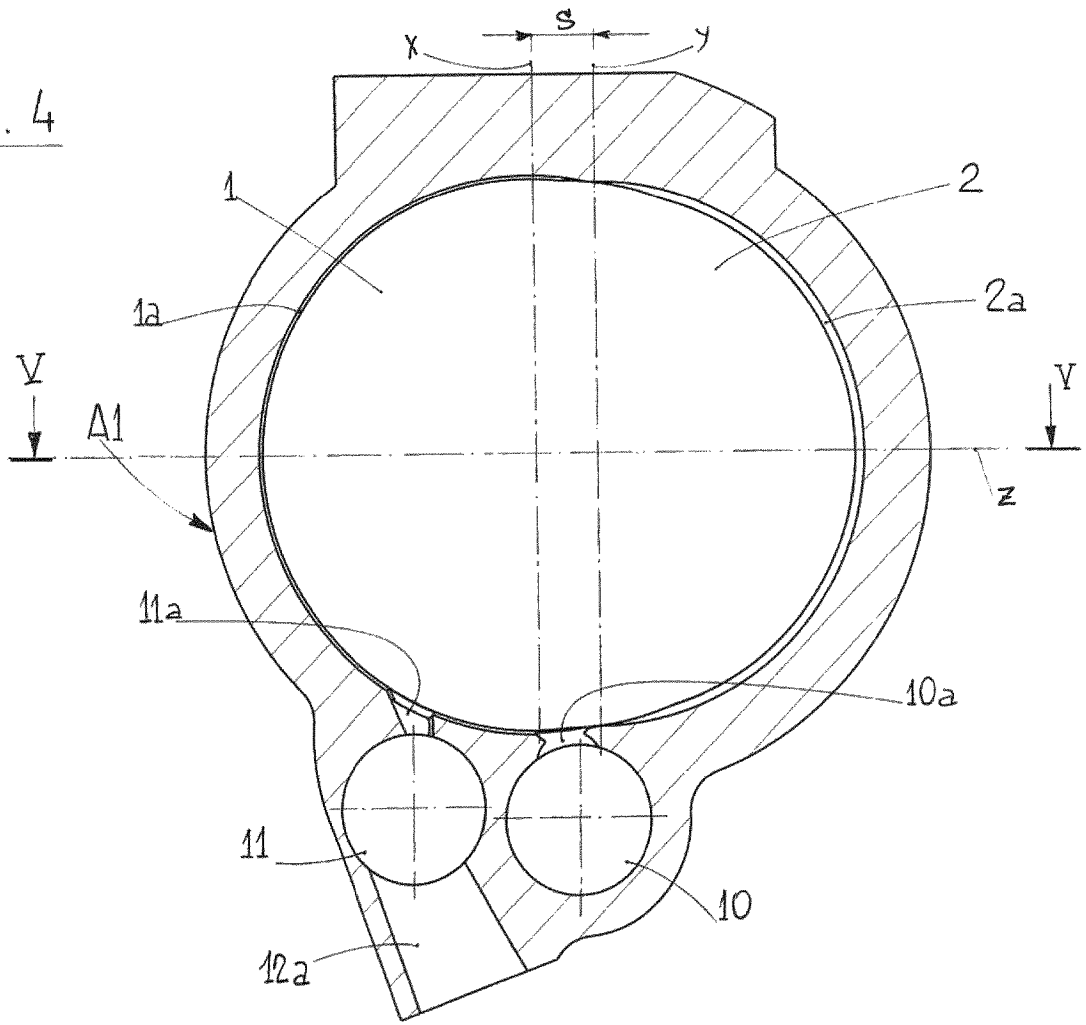
FIG. 4 represents a view in vertical section, analogous to the view of FIG. 3, but more lateral, according to the plane of section IV-IV of FIG. 5.
Figure 19:
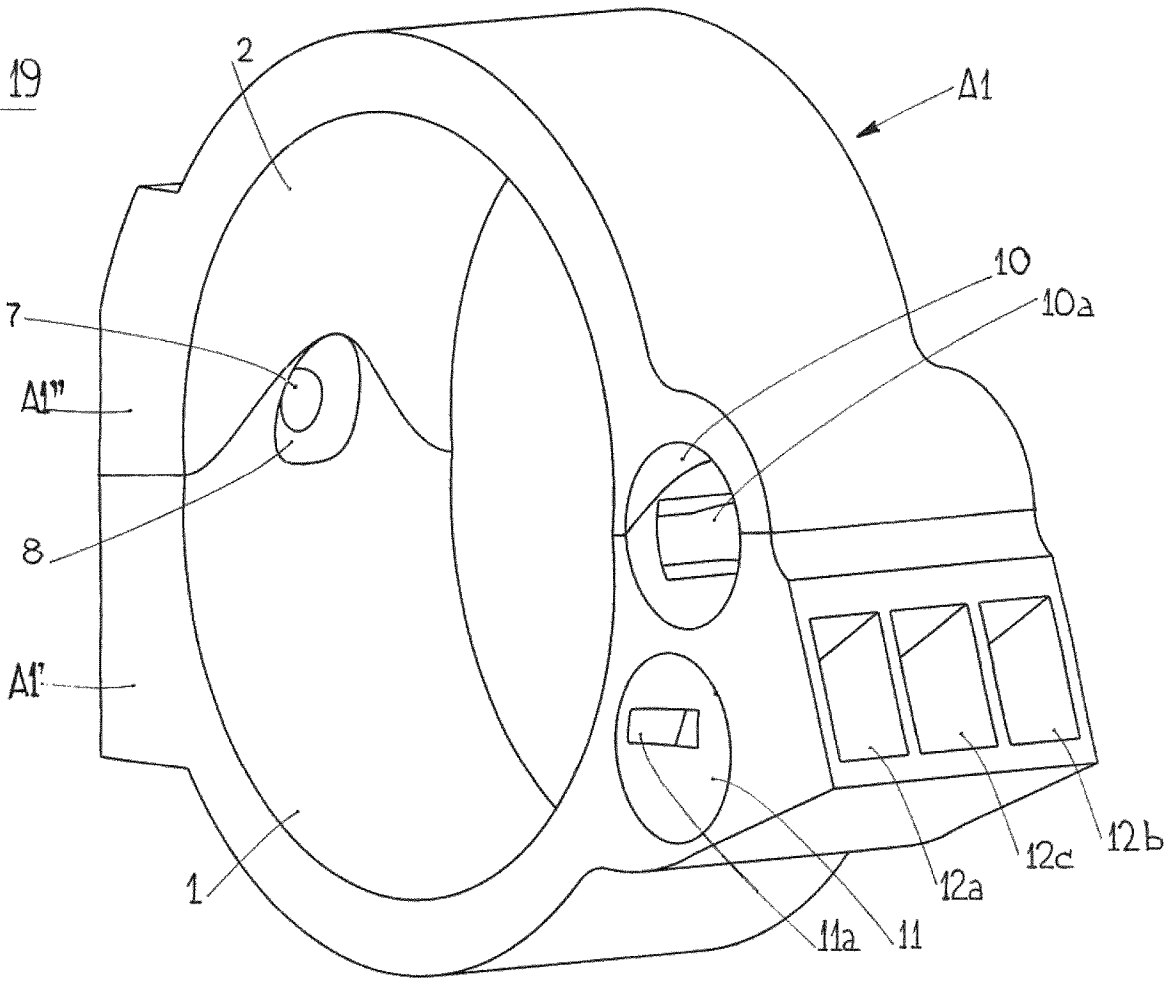
FIG. 19 represents a perspective view of the same stator of FIG. 2, illustrated in a bottom view, to underline the separated distinct outlets of the burnt gases and the washing mixture, apart from sucking outer air.

By referring to FIGS. 3-4 and 19, the same discharge seat (11) communicates with other three lower ducts (12*a*-12*b* and 12*c*). In particular the side lower ducts (12*a* and 12*b*) are aligned with the upper ducts (11*a*-11*b*) of the discharge seat (11) and they are destined to the discharge of the combustion gases coming from the expansion chamber (1), whereas the lower central duct (12*c*) is aligned to the upper duct (11*c*) of the same discharge compartment (11) and it is destined to the discharge of the washing air only outgoing from the same expansion chamber (1), as better specified hereinafter.

Figure 5:
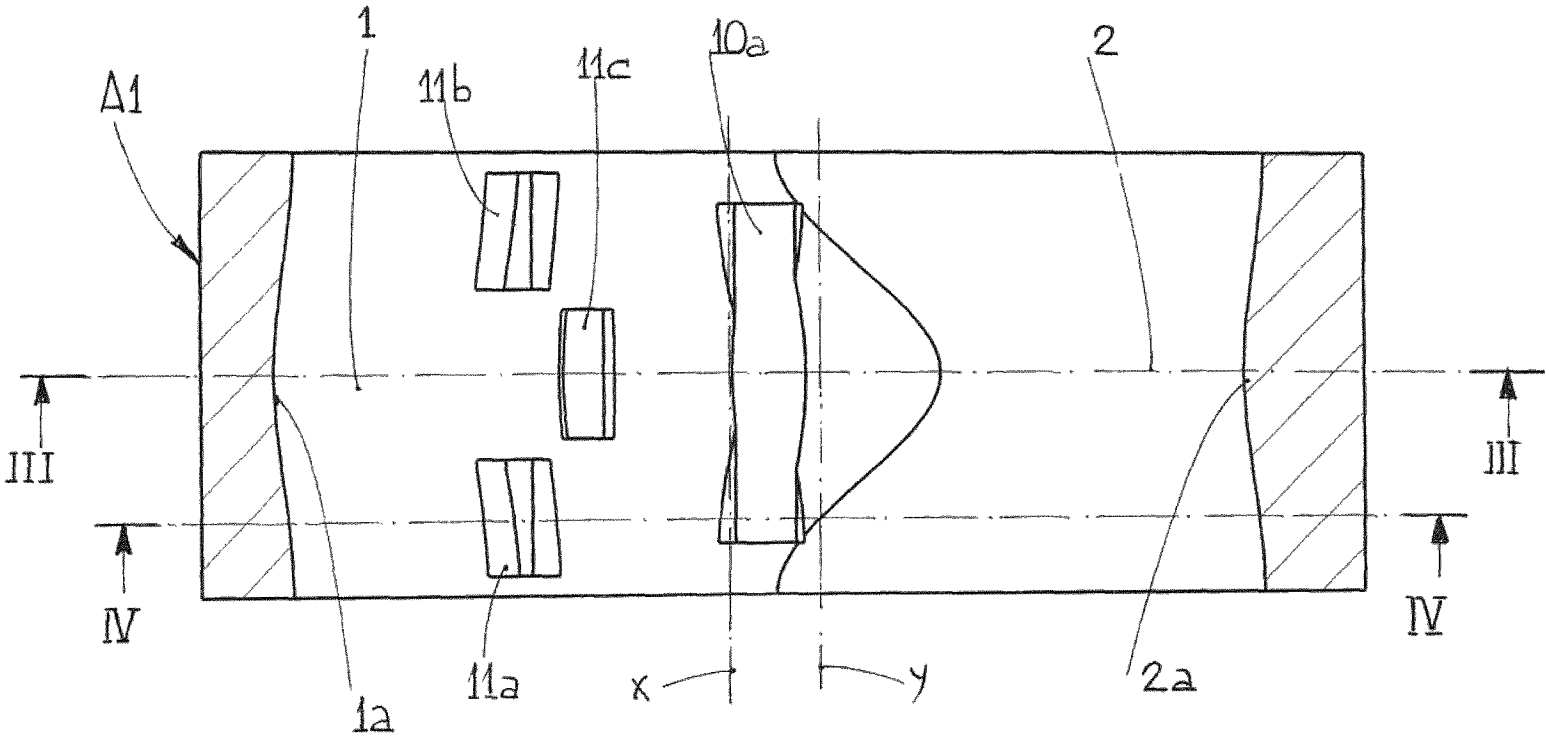
FIG. 5 represents a cross view of the stator of FIGS. 2, 3, and 4, according to the plane of section V-V of FIGS. 3 and 4.

By particularly referring to FIGS. 5 and 6, the basis of the present invention is the curved shape of the inner surface (1*a*) of the expansion compartment (1) and of the inner surface (2*a*) of the compression compartment (2) of the stator (A1), as the outer side surface (B1') of the expansion rotary element (B1) is curved and as the outer side surface (B2') of the compression rotor element (B2) is curved.

By referring in more details to FIG. 5, it can be understood that the expansion compartment (1) of the stator (A1) has a concave inner side surface (1*a*) (deepening into the compartment wall) whereas the compression compartment thereof (2) has a convex inner side surface (2*a*) (protruding from the compartment wall), the concavity and convexity being implemented with identical arc profile and depth value, apart from with corresponding radius of minimum and maximum development, with respect to the respective axes thereof (x-y).

By referring to FIG. 6, it can be understood that the expansion rotating element (B1) is equipped with a convex outer side surface (B1') (protruding from the surface), whereas the compression element (B2) is equipped with a concave outer side surface (B2') (deepening into the surface), the convexity (B2') and the concavity (B1') being implemented with an arc-like profile and a depth value which are identical therebetween and corresponding to the arch profile and to the depth value of the inner side surfaces (1*a* and 2*a*) respectively in the compartments (1 and 2) of the stator (A1).

Due to the effect of the correspondence between these profiles of the depths and the base radii of the side surfaces (1*a*-2*a*) of the stator (A1) to those (B1') of the expansion element (B1) and the side surfaces (B2') of the compression element (B2), it is evident that the sliding and the rotation of the elements (B1-B2) within the stator (A1)) always takes place under the condition of maximum tight for the several phases of the thermodynamic cycle, as exemplified in the several FIGS. 7 to 17 and better exemplified hereinafter.

It is also evident the fact that the depth and shape of the arches (1*a*-2*a*-B1' and B2'), with respect to the traditional situation of the smooth and cylindrical walls of the current engines with "rotating piston", determines an increase in an engine capacity of equal overall dimensions and identical wheelbase (s) or, the overall dimensions and the requested capacity being equal, determines a consistent reduction of the wheelbase (s) between the vertical planes (x-y).

For what illustrated above, it is evident that the greater advantage of the present solution, the capacity being equal, is to allow a good reduction in the value of the wheelbase (s), with consequent decrease in the length of the stroke which the hinge element (B3) has to perform up to now in order to guarantee the continuous sliding of the rotor surfaces (B1'-B2') along the stator surfaces (1*a*-2*a*). The decrease in the stroke of the hinge element (B3) allows the substantial decrease in the current accelerations and decelerations along each single stroke, by guaranteeing the decrease in the vibrations and the better engine stability.

Ultimately, the present invention, still the capacity and the substantial overall dimensions of the engine of the mentioned type, allows a considerable decrease in the vibrations caused by the length and sudden changes in speed of the hinging element (B3), thus it allows increasing the number of revolutions of the stator (B), with decrease in the balancing problems, according to one of the specified objects.

The same limitations of the wheelbase (s) allows then to decrease even the overall dimension front surface, in the rotation of the expansion element (BE) around the drive shaft (80), with consequent possibility of increasing considerably the diameter of the same shaft, according to the engine capabilities, apart from the possibility of improving the application of suitable bearings and guiding bearing liners of the same drive shaft (80) and of the rotating elements (B1-B2) on the support or basement (A), according to another one of the specified objects.

Figure 8:
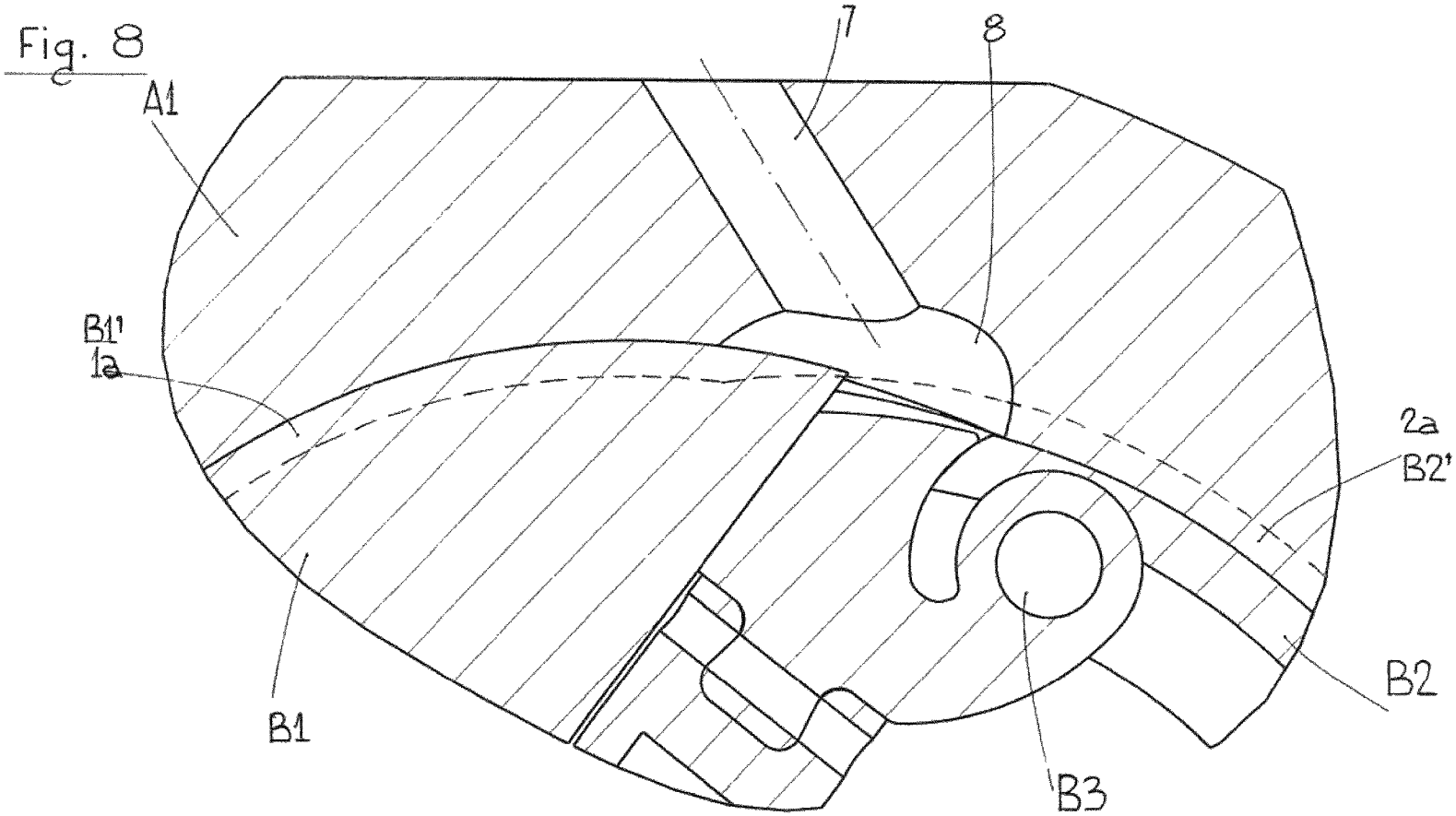
FIG. 8 represents a detailed and enlarged view of the same engine of FIG. 7, illustrating the phase of igniting the combustion mixture, subsequent to the phase of maximum compression of the combustion air and preceding the useful expansion phase.
Figure 9:
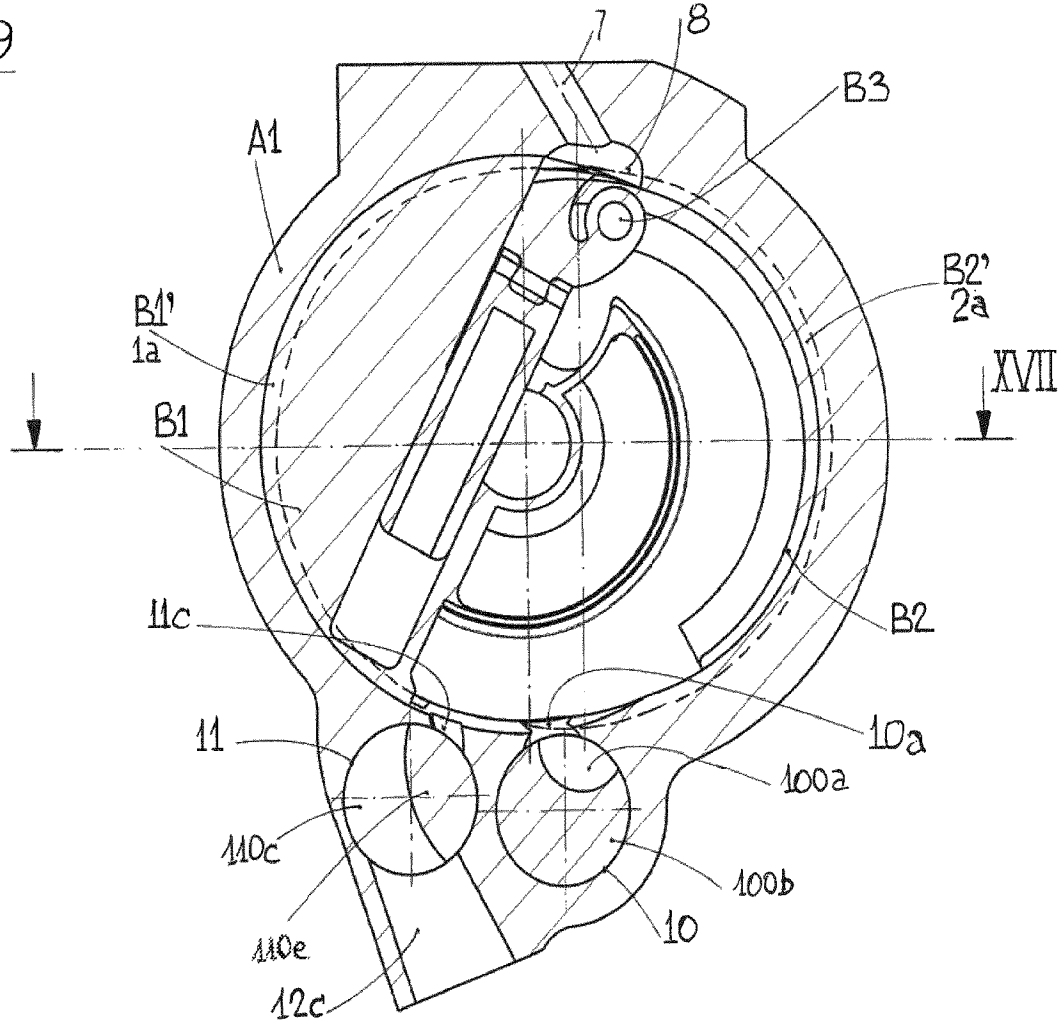
FIG. 9 represents an engine view similar to the view of FIG. 7, illustrating the initial useful expansion phase, immediately subsequent to the ignition phase of FIG. 8, with closing of the discharge duct and with initial closing of the outer air sucking duct.

By particularly referring to FIGS. 8 and 9, it is still noted that, with respect to the cylindrical side walls of the previous solutions of spark-ignition engine with double rotation centre, the presence of convexity (B1') of the expansion element (B1) within the concavity (1*a*) of the stator expansion compartment (1) determines a considerable increase in the surface pushing the combustion gas, exactly at the time of maximum power expressed in the ignition chamber (8), according to another of the specified objects.

According to the structural solution exemplified in particular to FIGS. 2-6 and 18, a sucking valve (100) is housed in the seat (10) of the stator (A1) and has a not represented control side which is connected to the drive shaft (80) in order to receive a rotation motion in the opposite direction with respect to the rotation direction of the rotor (B) and of the same shaft (80).

The sucking valve (100) is substantially constituted by a cylindrical body (100*b*) which is equipped with a cylindrical groove (100*a*) and which, lying in axis with the slot (10*a*) of the stator (A1), allows the sucking within the department (2) for sucking and compressing the outer air coming from suitable openings (9) existing on the covers (A2 and A3) of the stator (A1), as better specified hereinafter.

Still by referring to the structural solution of FIGS. 2-6 and 18, a discharge valve (110) is housed in the seat (11) of the stator (A1) and has a not represented control side, which is connected to the drive shaft (80) to receive a rotation motion in the opposite direction with respect to the rotation direction of the rotor (B) and of the same shaft (80).

The discharge valve (110) is substantially constituted by a cylindrical base body (110*e*) whereon two substantially half-cylindrical side seats (110*a* and 110*b*) and a substantially half-cylindrical central seat (110*c*) are obtained, this latter seat (110*c*) being arranged with a slightly different angulation, with respect to the seats (110*a* and 110*b*) and being separated by the same by means of gates (110*d* and 110*f*).

By referring to FIGS. 2-5 and 18, it appears clear that by housing and rotating the valve (100) within the sucking compartment (10), the cylindrical groove (100*a*) positions in axis with the slot (10*a*) of the compression compartment (2), by allowing the inflow of outer air in the sucking chamber (2), whereas when the side seat (110*a*) is turned in other positions, the inflow of outer air from the slot (10*a*) is prevented.

Still by referring to the same FIGS. 2-5 and 18 and 19, it appears clear that the insertion and the rotation of the valve (110) in the discharge seat (11) of the stator (A1) can determine the alignment of the central compartment thereof (110*c*) with the central stator slots (11*c* and 12*c*) and, with a previous minimum angular rotation of the same valve (110), it can determine instead the alignment of the side compartments thereof (110*a*-110*b*) with the upper stator slots (11*a*-11*b*) and with the lower stator slots (12*a*-12*b*).

Figure 11:
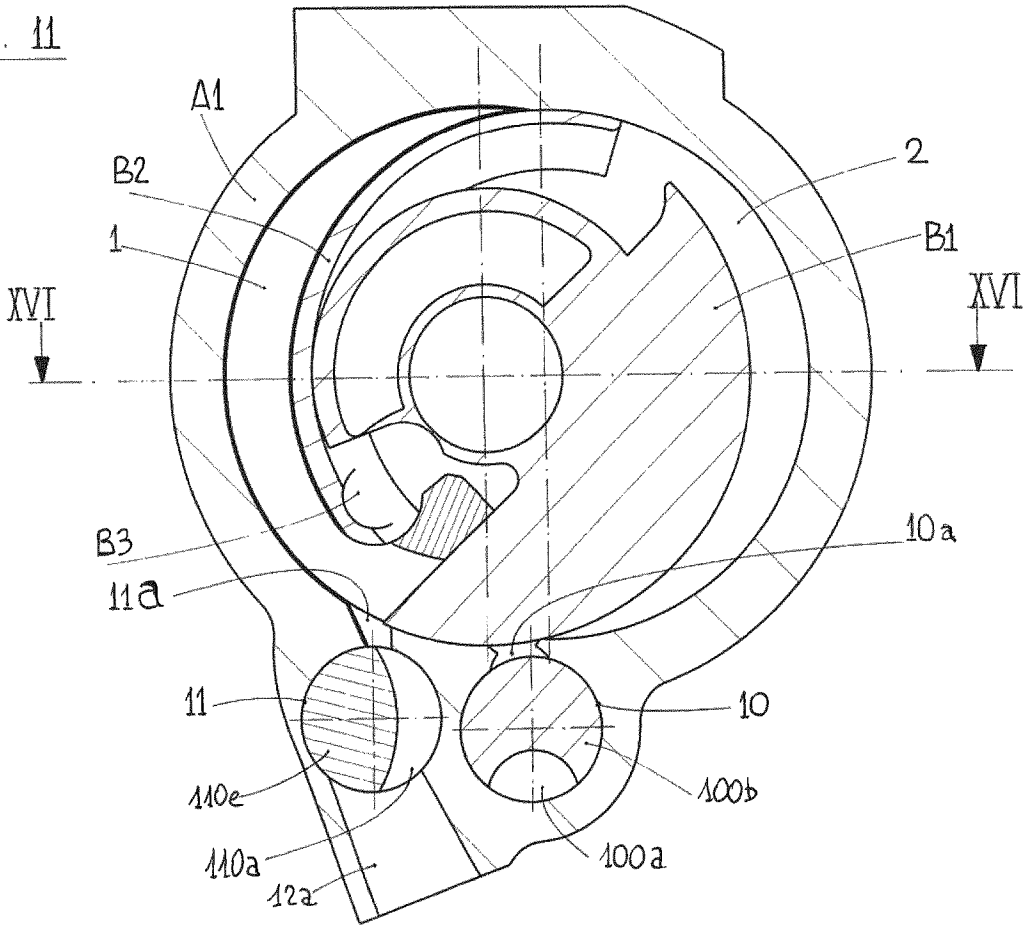
FIG. 11 represents a view of the same engine of FIG. 10, approximately according to the plane of section IV-IV of the stator of FIG. 5 and according to the corresponding plane XI-XI of FIG. 16, illustrating the final phase of maximum expansion, with the already started phase for discharging the burnt gases and with ending of the phase for sucking the outer air.
Figure 12:
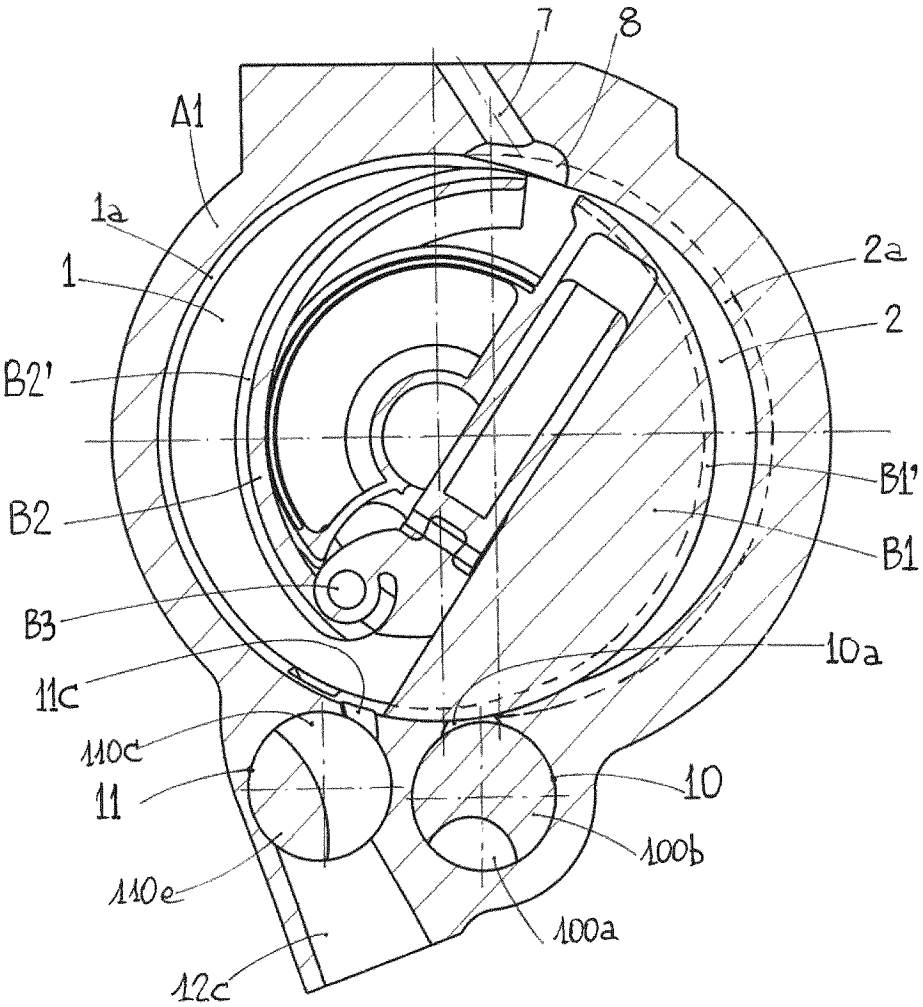
FIG. 12 represents a view of the engine in a moment immediately subsequent to the one of FIG. 11, but illustrated according to the planes of section III-III of FIG. 5 and XII-XII of FIG. 16, illustrating the almost contemporary starting even of the phase for washing the engine, with the air coming also from the side inlets of the stator covers, passing from the compression compartment, to the ignition compartment, to the expansion compartment, to outgo from the discharge valve but from a different hole with respect to the one for discharging the exhaust gases.

As already specified, the side lower ducts (12*a* and 12*b*) are destined to convey the discharge of the combustion gases coming from the expansion chamber (1) by means of the upper side slots (11*a*-11*b*), as exemplified in FIG. 11, whereas the lower central duct (12*c*) is destined to convey the discharge of the engine washing air coming from the same expansion chamber (1) by means of the central upper slot (11*c*), as represented by way of example in FIG. 12. In the phase for igniting and expanding the rotor (B1), as well as in the phase of maximum compression of the combustion air, the full body (110*e*) of the discharge valve (11) and the same expansion body (B1) prevent the inflow to the discharge compartments (12*a*-12*b* and 12*c*), as exemplified in FIGS. 7. 9 and 10.

In order to perform the mentioned function of adjusting the discharge of the combustion gases and of the washing mixture, the discharge valve (11) is necessarily equipped with a rotation motion thereof, within the discharge compartment (11), such motion and the speed thereof being determined by the mechanical connection thereof to the drive shaft (80), for a good synchronization of the various phases. Analogously, even the sucking valve (10) will have to be connected to the same drive shaft (80) with a right speed ratio, in order to guarantee the synchronization of the sucking phases thereof with the thermodynamic phases of the engine under examination. The adjustment of such rotation speeds of the mentioned valves (10 and 11), with respect to the rotation speed of the drive shaft (80) is determined by speed transmission ratios which are known on themselves and therefore are not considered to be further exemplified.

Having thus described the main portions of the engine, the operation thereof is summarized herebelow, even with the help of the figures of views in vertical sections from 7 to 14 and with the views in cross sections from 15 to 17.

Figure 7:
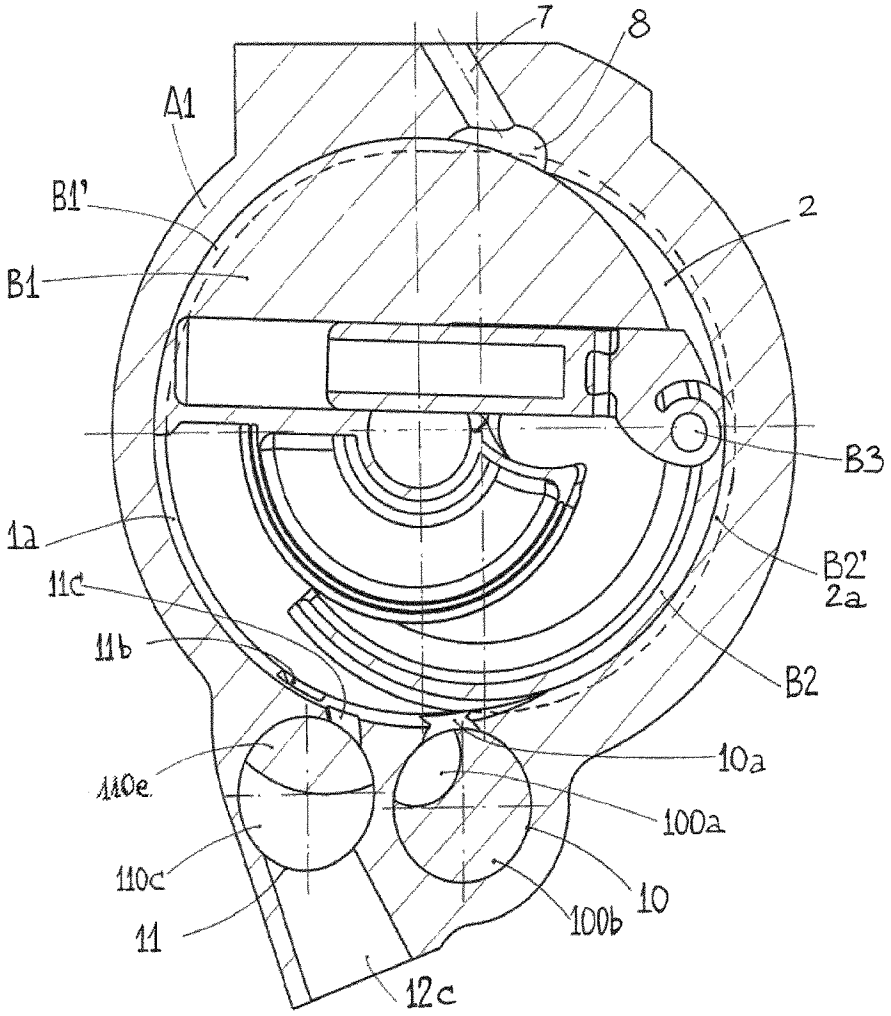
FIG. 7 represents an intermediate vertical section view of the rotor portions of FIG. 8 housed in the stator of FIG. 3, illustrating a final compression phase of the combustion air, which phase is contemporary to a phase for sucking outer air, whereas a valve prevents the discharge thereof.

As already mentioned, FIG. 7 represents a view of the engine with curved walls under examination, illustrating the final phase for compressing the combustion air within the rotor compartment (2), whereas the cylindrical groove (100*a*) of the sucking valve (100) allows starting the sucking from the duct (9) of the covers (A2-A3) and the passage of the outer air which, by means of the slot (10*a*), is placed in circulation in the portion of the compartments (1-2) not engaged by the rotating elements (B1-B2), whereas the closing of the discharge valve (100) prevents the discharge of the same air sucked by the slots (11*a*-11*b* and 11*c*).

Figure 17:
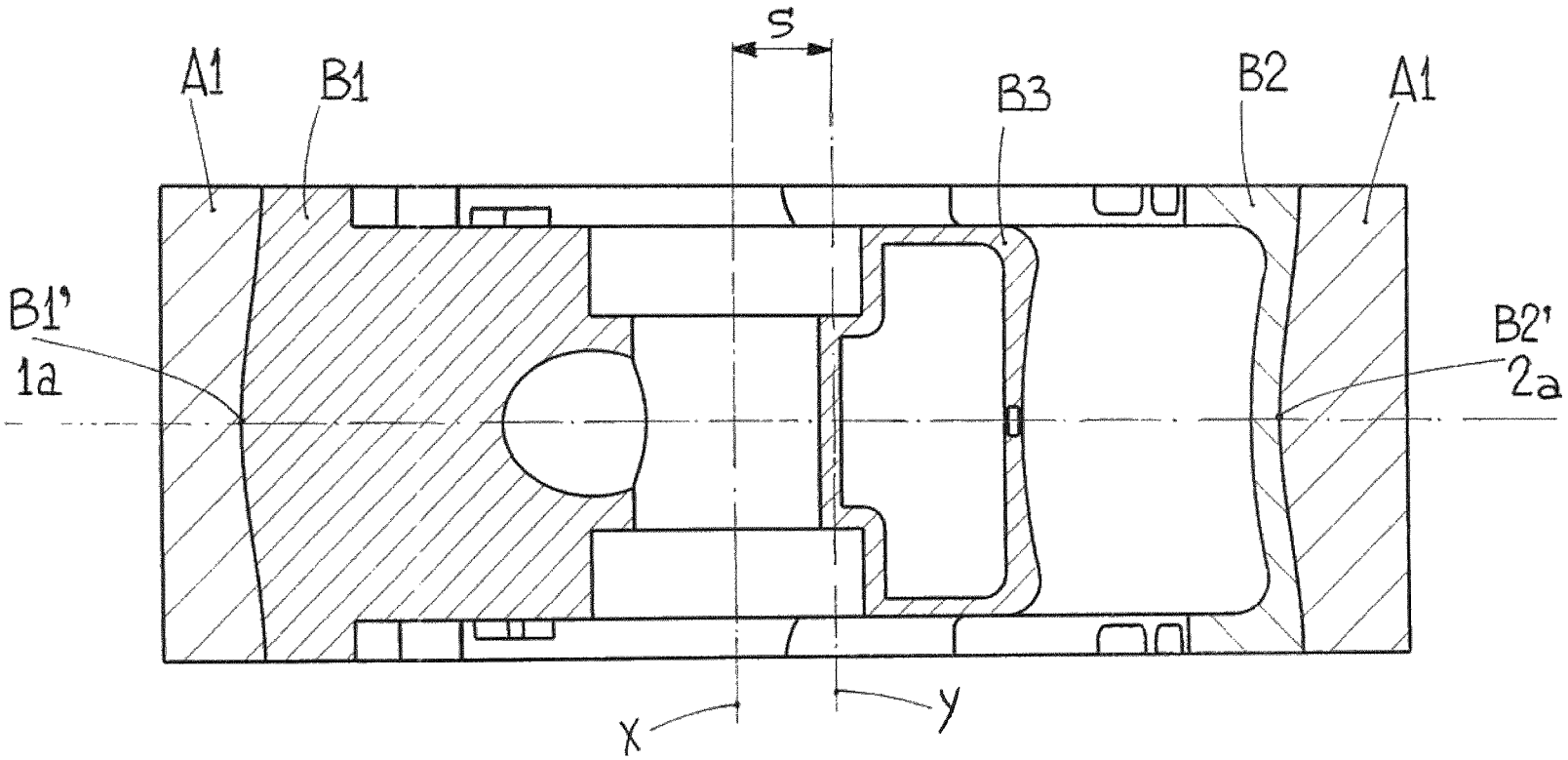
FIG. 17 represents a view in cross section of the engine of FIG. 9, according to the plane of section XVII-XVII of FIG. 9, illustrating the initial useful phase of the expansion rotor element, consequent to the phase of maximum compression of the combustion air and to the mixing thereof to the fuel in the stator ignition chamber.
Figure 18:
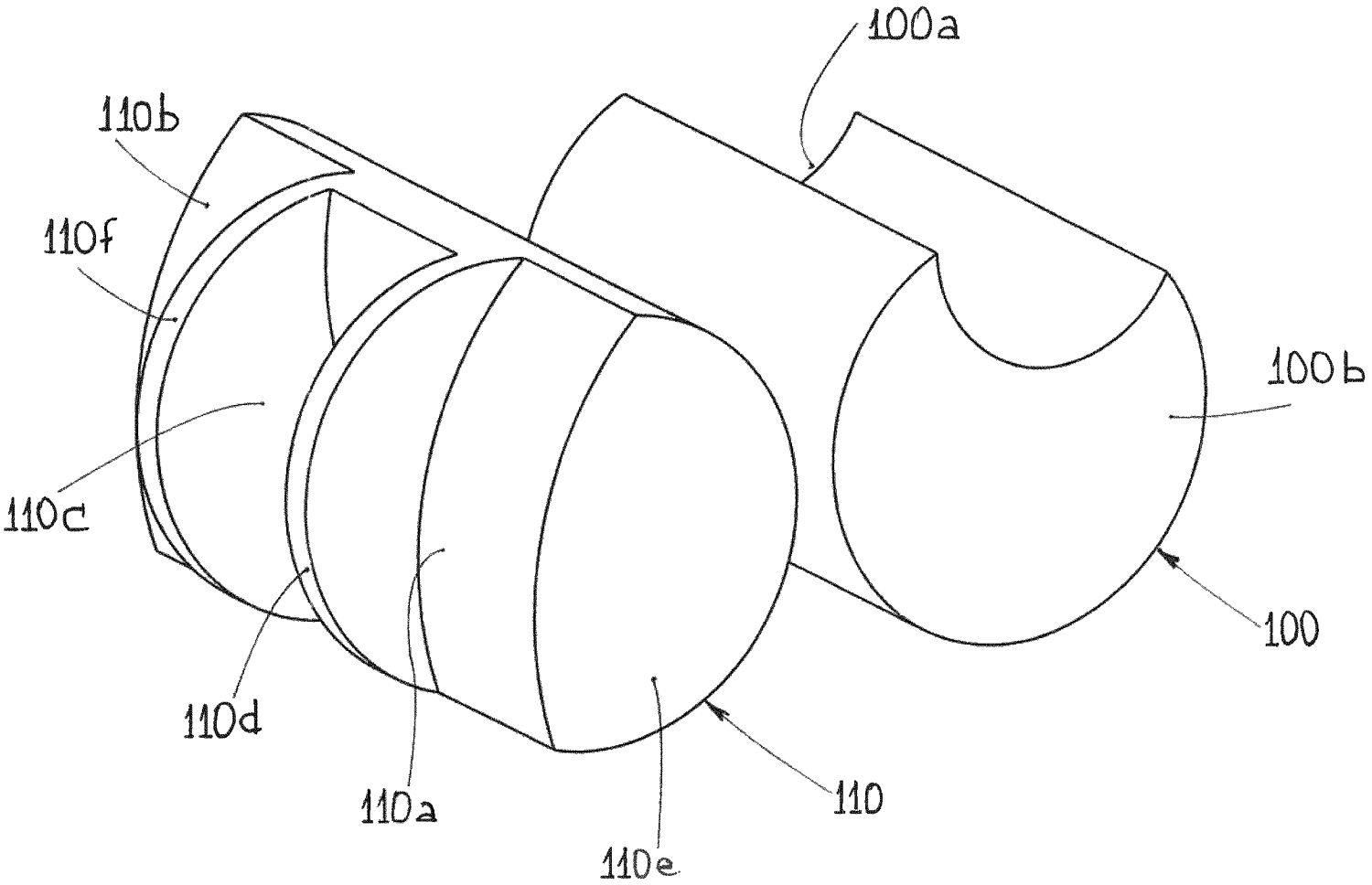
FIG. 18 represents a perspective view of the pair of valves to be inserted in the suitable compartments of the stator of FIGS. 2-3 and 4, for the discharge of the burnt gases and the washing mixture, apart from the fresh air inlet to enter the thermal cycle of the engine of FIG. 1.

With the maximum compression of the combustion mixture, exerted by the counter-clockwise rotation of the compression element (B2), as represented in FIGS. 8-9 and 17, one reaches the phase of the explosion thereof in the combustion chamber (8), determined by the ignition of the spark plug or the injector which is arranged in the duct thereof (7). In this phase, the outer air is always sucked by the cylindrical groove (100*a*) of the valve (100) and, by means of the slot (10*a*), expands in the whole stator compartment (1-29) which is not engaged by the curved surface for sliding the compression (B2) and expansion (B1) rotors, the evacuation from the discharge valve (100) being still prevented.

At the time of the combustion mixture ignition within the combustion chamber (8), the produced energy discharges on the front surface of the rotating expansion element (B1) which, as specified above and with respect to the known art, is increased by the convex curve (B1') of the same rotor (B1) and by the corresponding hollow curve (1*a*) of the stator (A1). In this way a greater pushing surface is guaranteed, exactly at the time of maximum expansion force, apart from guaranteeing a greater expansion volume compensating the greater volume of sucked and compressed air which can be accumulated in the compartment (2) of the same stator (A1).

Figure 10:
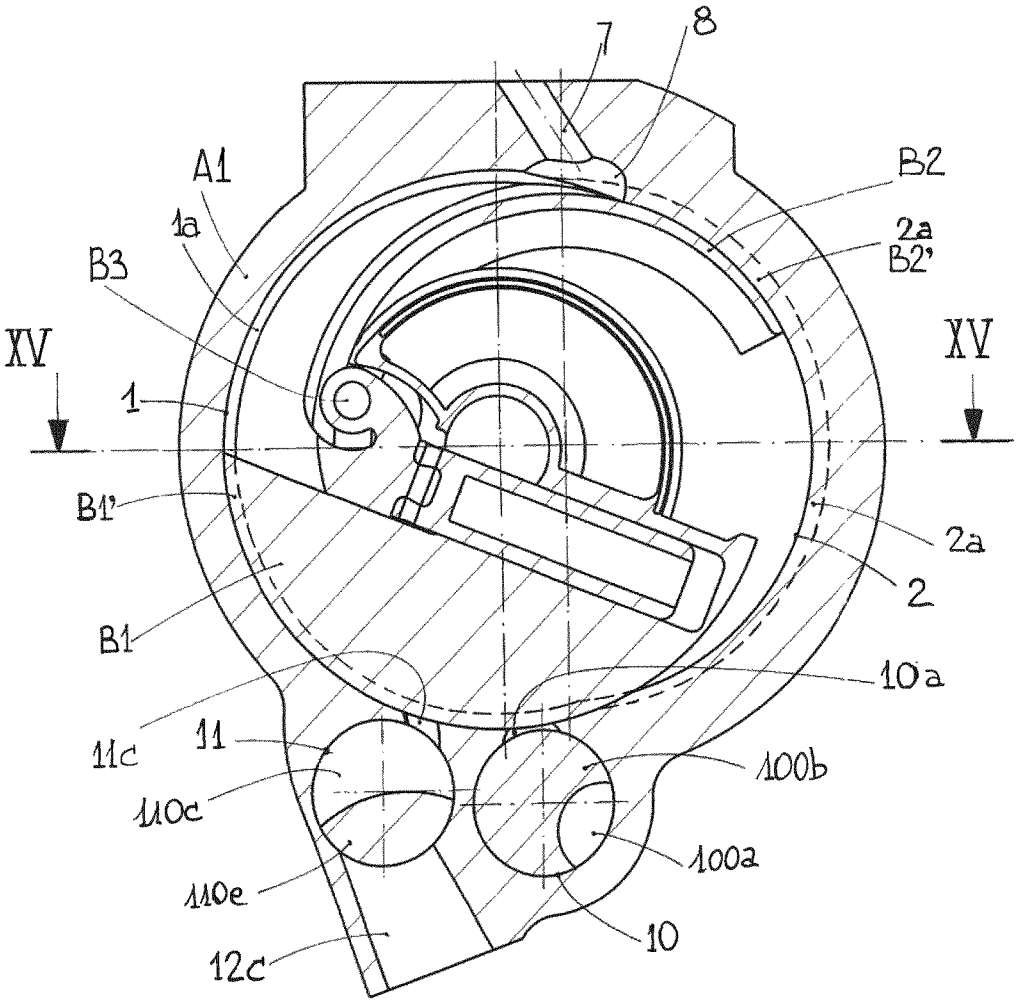
FIG. 10 represents a view of the same engine of FIG. 9, in a subsequent intermediate useful expansion phase, with closing of the duct for discharging the exhaust gases by means of the expansion rotating element and with contemporary closing of the air-sucking duct, even thanks to the same expansion element.
Figure 15:
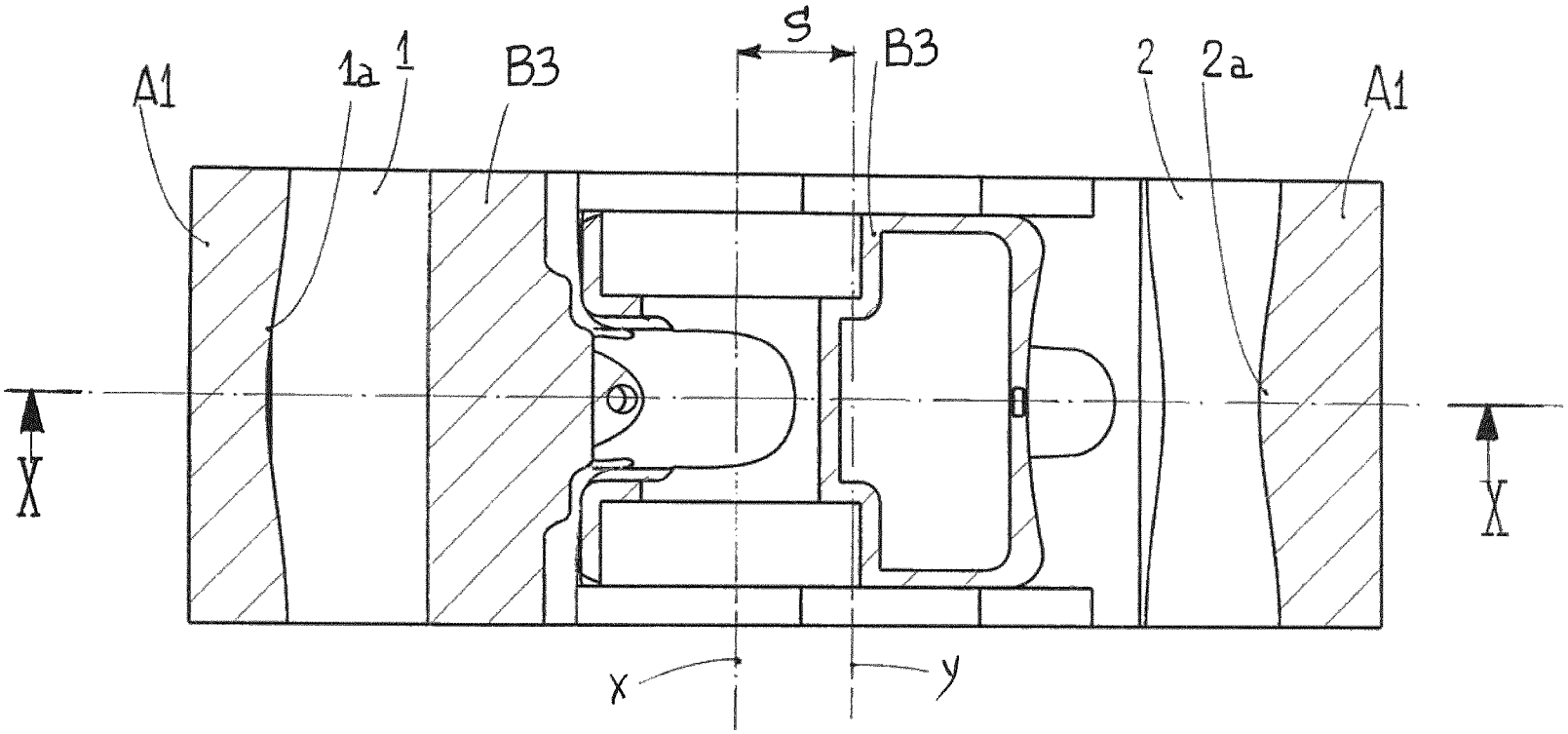
FIG. 15 represents a view in cross section of the engine of FIG. 10, according to the plane of section XV-XV thereof, illustrating an intermediate phase of useful expansion.

By referring to FIGS. 10 and 15, the useful phase for expanding the combustion gases within the expansion compartment (1) determines the rotation of the expansion element (B1) and of the not represented drive shaft thereof (80), whereas the same rotor (B1) and the sucking valve (100) close the slot (10*a*), thus preventing the passage of the outer air into the sucking compartment (2).

Figure 16:
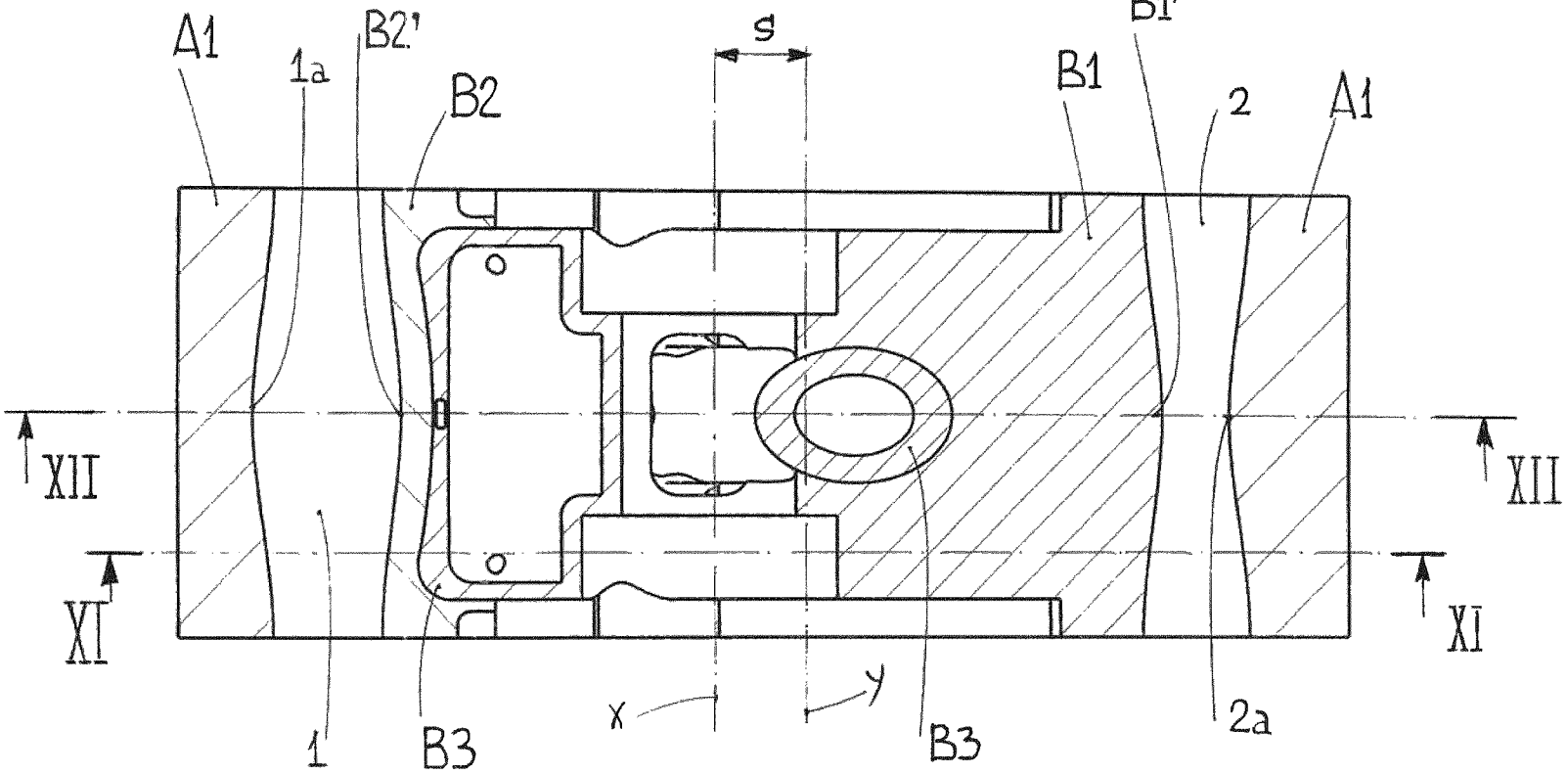
FIG. 16 represents a view in cross section of the engine of FIG. 11, according to the plane of section XVI-XVI thereof, illustrating the phase for discharging the burnt gases.

By referring to FIGS. 11 and 16, the ending of the useful phase for expanding the rotating element (B1) is represented, with the start of the phase for discharging the burnt gases by means of opening the compartments (110*a* and 110*b*) of the valve (110) and the alignment thereof with the corresponding upper slots (11*a*-11*b*) and with the lower slots (12*a*-12*b*) bringing the combustion gases to deposit in the manifold (121) of the discharge muffler (120). In this phase, a push to outgo the combustion gases is given by the rotation of the compression rotor (B2) within the expansion compartment (1), whereas the previously sucked air is compressed within the compartment (2) and in the other free spaces of the compartment (1), wherein it is pushed by the contemporary rotation of the expansion rotor (B1).

By referring to FIG. 12, the rotation continuing by inertia, the expansion rotor (B1) starts to compress the air in the compartment (2), whereas the same air and the residual combustion gases which are still present in the compartment (1) are pushed by the compression rotor (B2), for the washing of the same compartment (1). With the push of the rotor (B2), the same mixture of residual gases and washing air is forced to outgo from the duct (12*c*), passing through the central discharge hole (11*c*) of the stator (A1) and through the central seat (110*c*) of the valve (110).

Figure 20:
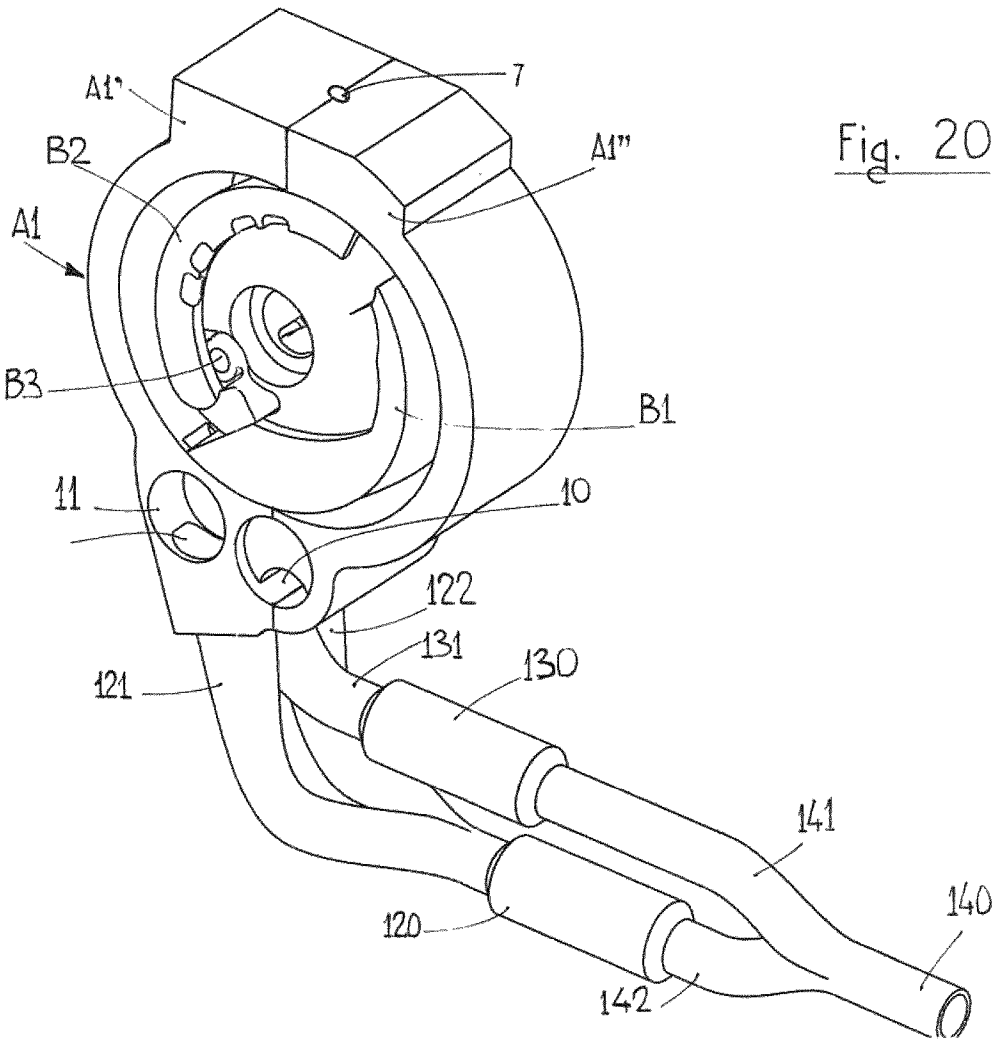
FIG. 20 represents a perspective view of the subject motor, when it is associated to the two discharge ducts of FIGS. 18 and 19, which are interposed between the same engine and the discharge end duct.

By referring to FIGS. 19 and 20, it appears evident that the ducts (12*a* and 12*b*) are connected to a usual discharge muffler (120), by means of two respective pipelines (121-122), whereas the stator central duct (12*c*) is connected to a catalytic muffler (130), by interposition of the tube (131). The mixture of the washing air and combustion gases, coming from the expansion compartment (1) is then treated by the catalytic muffler (130), before being ejected from the ending discharge duct (140), wherein it arrives by means of the duct (141), to go out together with the residues of combustion gases which, by means of the duct (142), connects the same discharge tube (140) to the usual muffler (120). Of course, the residues of combustion gases and washing air can be further purified, by interposing one or more additional usual mufflers (120), before the ending discharge tube (140). The best conditions for discharging the combustion gas and the washing mixture are then implemented, according to one of the specified objects.

Figure 13:
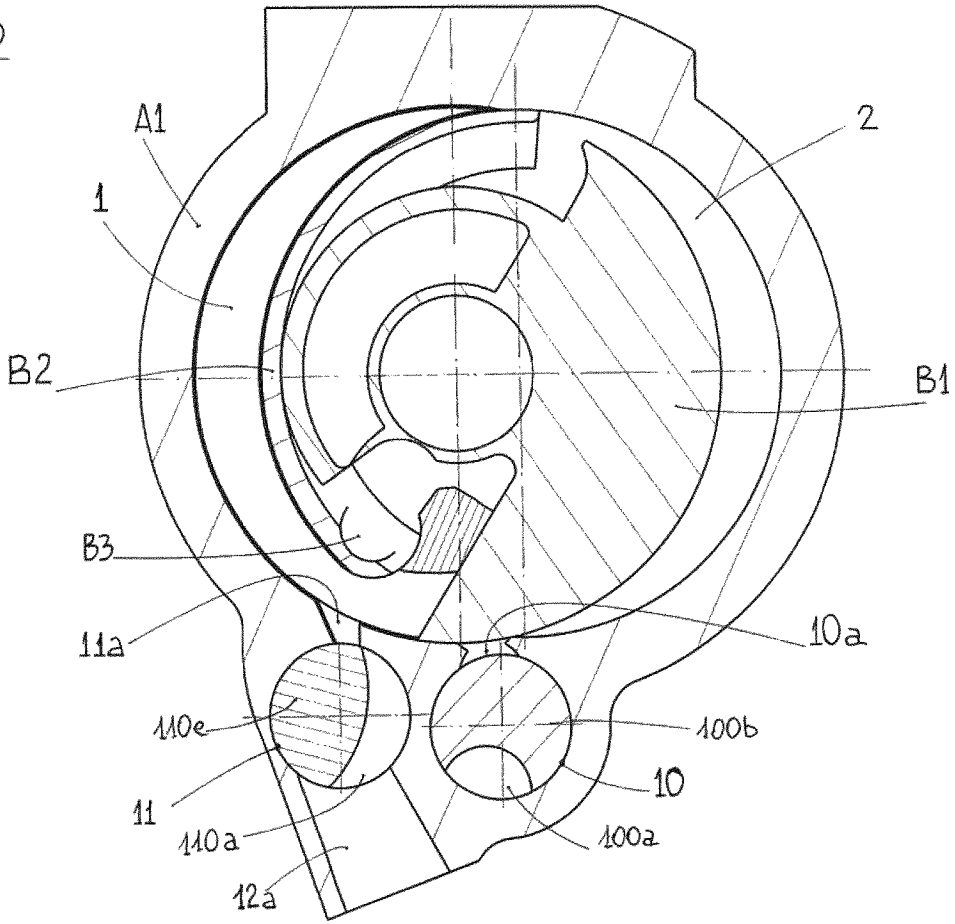
FIG. 13 represents a view of the same engine of FIG. 11, in a moment immediately subsequent to that of FIG. 12, illustrating the end of the washing phase, with closing of the discharge valve and the continuation of the side sucking of outer air, whereas the main sucking valve remains still closed.

By referring to FIG. 13, contemporary to the activation of the passages (11*c*-110*c*-12*c*), as to FIG. 12, one finds the closing of the upper side ducts (11*a*-11*b*) and of the lower side ducts (12*a*-12*b*), by interposing the closed body (110*e*) of the discharge valve (110), thus avoiding that the washing mixture existing in the compartment (1) can be discharged directly, without passing through the catalytic muffler (122), as exemplified above.

Figure 14:
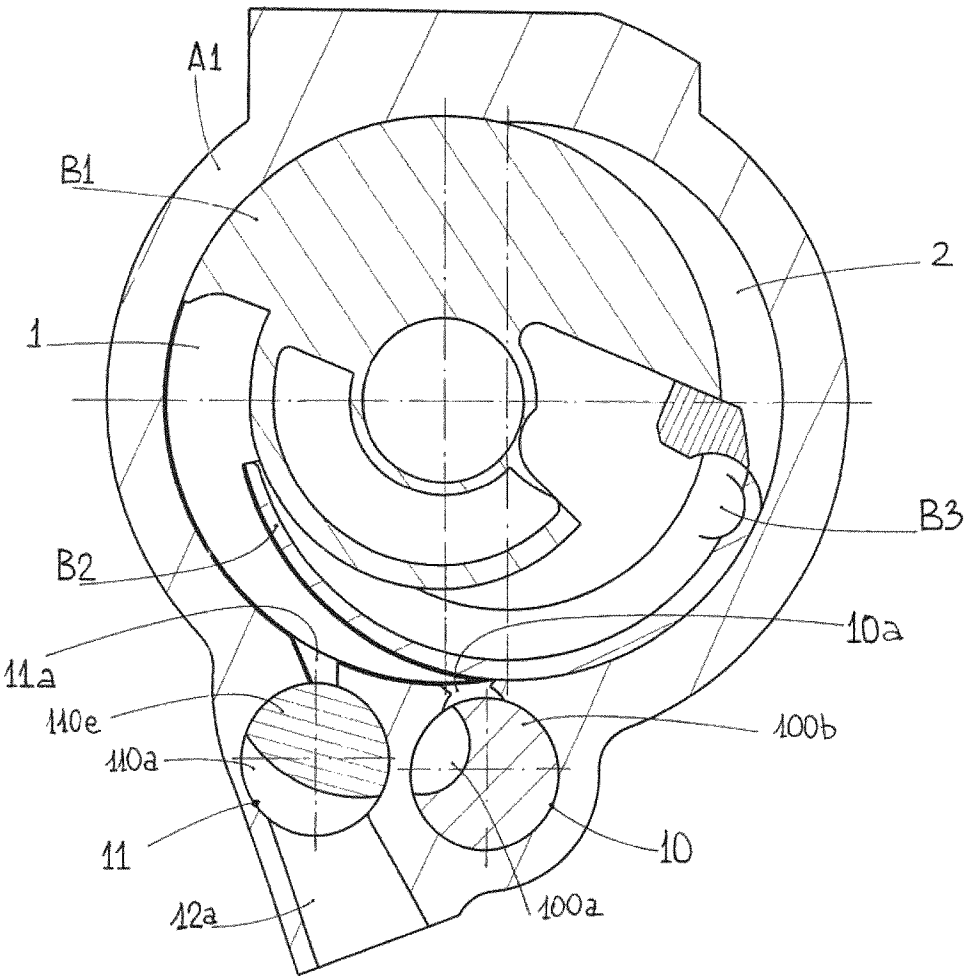
FIG. 14 represents a view according to the plane of section IV-IV of the stator of FIG. 5, like the view of FIG. 13, illustrating the phase for compressing the combustion air, already started thanks to the compression rotating element, whereas even the sucking phase is started with the opening of the suitable valve and with the closing of the discharge compartment.

By referring to FIG. 14, the rotation continuing by inertia of the rotor (B1) in the compartment (1) and thus even of the compression rotor (B2) in the compartment (2), with respect to the situation of FIG. 13, an ever higher compression of the combustion air of the same compartment (2) is concretized, whereas new outer air starts to enter the compartment (1), entered by the cylindrical groove (100*a*) of the sucking valve (100) and passing through the duct (10*a*), in view of a new thermodynamic cycle, of the engine under examination, according to what already described. The closing of the body (110*e*) of the discharge valve (110) on the ducts (11*a*-11*b* and 11*c*), prevents the outgo and discharge from the lower ducts (12*a*-12*b*-12*c*) of the air just arrived in the compartment (1).

From what described up to now by way of example, it appears clear that the presence of curved inner surfaces, with the cavity (1*a*) in the expansion compartment (1) and with the convexity (2*a*) in the compression compartment (2) of the stator (A1), associated to the presence of curved side surfaces, with the convexity (B1') of the expansion rotor element (B1) and with the cavity (B2') of the compression rotor element (B2), as the curved surfaces (1*a*-2*a*-B1' and B2') have an identical profile and size allowing to tightly slide the rotor elements (B1 and B2) in the seats (1-2) of the stator (A1), by determining a considerable increase in the expansion (1) and compression (2) volumes and therefore in the capacity of the engine, with respect to the corresponding surfaces of the stator (A1) and rotor elements (B1 and B2) of the previously implemented solutions, wherein the ratio between the compression (2) and expansion (1) volumes was directly proportioned to the distance or wheelbase (s) existing between the axes (x-y) of the stator (A1), apart from the different radius for forming the expansion compartment (1) with respect to the radius for forming the compression compartment (2).

Ultimately, the presence of the curved inner surfaces (1*a* and 2*a*) of the compartments (1 and 2) of the stator (A1), together with the corresponding presence of curved side surfaces (B1' and B2') of the rotor elements (B1 and B2) allow implementing an engine which, the overall dimensions and power being wholly equal, allow reducing to the minimum the distance (s) between the stator departments (1 and 2), according to the specified main object.

The reduction to the minimum of the distance or wheelbase (s) allows reducing to the minimum the difference in the translation speed of the hinging rotor element (B3) joining the rotor elements (B1 and B2), with consequent decreases in the mutual accelerations and decelerations and therefore by allowing even a considerable increase in the number of revolutions of the engine, according to another specified object.

The presence of the curved surface (B1') on the side surface of the expansion rotor (B1) allows increasing the pushing surface thereof, with respect to the prior art, exactly at the moment of maximum power expressed soon after the phase for igniting the mixture, according to another one of the specified objects.

The decrease in the distance between the axes (x-y) of the compartments (1-2) of the stator (A1) allows then to adopt a drive shaft (80) which has a larger diameter proportioned to the power of the same engine, apart from allowing a better arrangement of the supporting bearings thereof and to the side tight sealings, according to other specified objects.

The particular shape of the sucking (100) and discharge (110) valves, apart from the arrangement of the sucking (10*a*) and discharge (11*a*-11*c* and 12*a*-12*b*-12*c*) ducts allow separating the treatment of the combustion gases with respect to the washing mixture of the engine, according to another one of the specified objects.

Of course, and as already specified, the present solution is to be meant by way of example only and not with limitative purpose. It is possible, for example, to adopt profiles of convexities (1*a*-B1') and of cavities (2*a*-B2') having a different shape, with respect to the curved shape sofar illustrated, for example with a "V"-like shape or a more rectangular shape, as well as it is possible providing the implementation of sucking (10*a*) and discharge (11*a*-11*b*-11*c* and 12*a*-12*b*-12*c*) slots having a different shape or arrangement, with respect to the squared solutions which have exemplified.

It is still possible providing the unified control of a series of several sucking (100) and discharge (110) valves, for example in case of a stator (A1) including two or more series of rotating elements (B) which are suitably synchronized to feed one single drive shaft (80).

Figure 21:
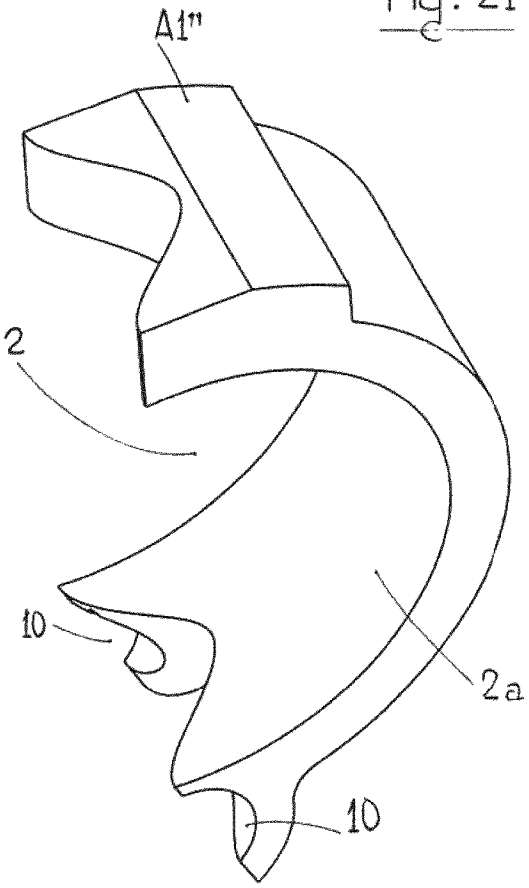
FIG. 21 represents a perspective and exploded view, of the same rotor of FIG. 2, implemented in two differently joinable portions.
Figure 21:
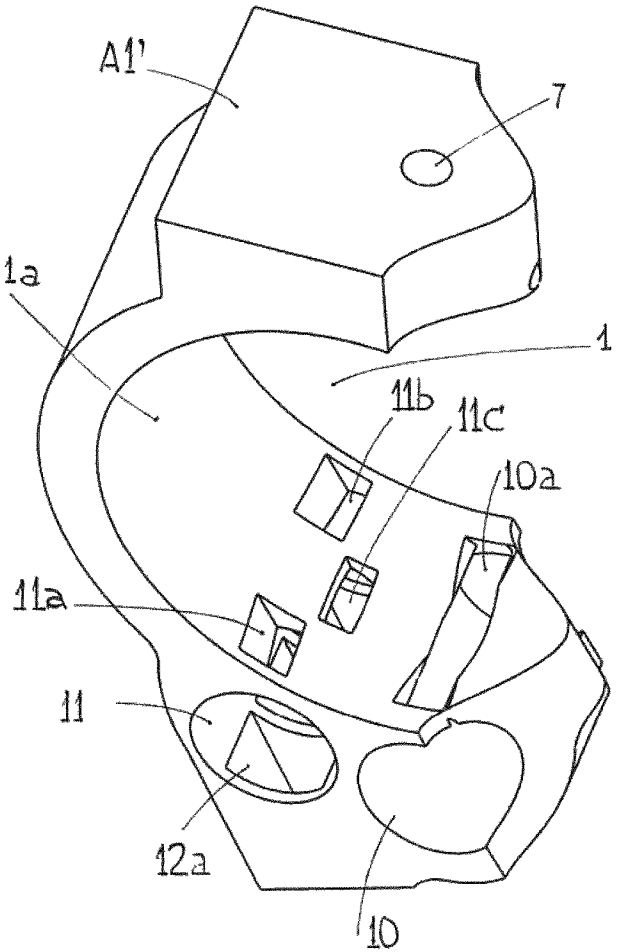

By referring to FIG. 21, an additional variant is proposed, with respect to the implementation of the stator (A1) in two bodies (A1'-A1") which can be placed side-by-side with respect to the solution exemplified in FIGS. 1-2-19 and 20, wherein the junction sides are orthogonal to the intersection profile between the concavity (1*a*) of the body (A1') and the convexity (2*a*) of the adjacent body (A1"), as well as other assembly structural forms of the same stator (A1) can be implemented.

These and other analogous modifications or adaptations are meant however to belong to the originality of the invention which is wanted to be protected.

In the following paragraphs are depicted preferred embodiments the invention:

1. Endothermic rotary engine with a double rotation center, optimized with curved walls and differentiated dischargings, which render the System thermodynamically and mechanically optimized, wherein the lateral surfaces of the rotating elements and the corresponding internal surfaces of the internal body have a specific shape containing cavities and convexities that manage to create an ideal relationship between the expansion and compression of the volumes that allows to reduce the inter-axis between the compression and the expansion elements of the rotor, as the corresponding inter-axis of the passage of the Stator or housing passage, with respect of an equivalent sized motor with flat un-curved surfaces, besides allowing the System to have two different and separate exhaust exits of gas, therefore taking advantage of the different and sequential phases of the exhaust and cleaning of the motor which completes the efficiency.

2. Endothermic rotary engine with a double rotation center, perfected with bent walls and differentiated dischargings, according to paragraph 1, wherein it is substantially created by one stator or housing (A) which is comprised by a central stator (A1), a lateral cover (A2) and an equivalent opposing cover (A3), which is also constituted by a rotor (B) which includes a rotating expansion element (B1), a rotating compression element (B2) and a linearly incrementing element (B3) in between the expansion element (B1) and the compression element (B2), where the central body (A1) of the stator (A) is equipped with a semi cylindrical compartment (1), that is destined mainly to the phase of expansion of the burned gas, and of a countered semi cylindrical compartment (2), that is destined mainly to the compression stroke of the combustion air called compartments (1, 2) presenting bent surfaces (1*a*, 2*a*), as are bent the side surfaces (B1' and B2') of the expansion elements (B1) and of the compression element (B2).

3. Endothermic rotary engine with a double rotation center, according to one or more of paragraphs 1 and 2, wherein in proximity of the inferior intersection between the concave wall (1*a*) of the bent compartment (1) and the convex wall (2*a*) of the bent compartment (2) of the stator (A1), the cylindrical seats are arranged (10-11) respectively destined to live the valve of suction (100) and the valve of discharging (110). the suction seat (10) being in communication with the compartment (1-2) of the Stator (A1) by means of a loophole (10*a*) that is extended by a good portion by the breadth of the same stator (A1), while the Stator discharging seat (11) has two superior conducts side (11*a*, 11*b*) and a Station (11*c*) that communicate with the compartment one of expansion (1) of the stator (A1), called central lead (11*c*) being however translated by some degrees with respect to the conducts (11*a*-11*b*), of delay in the sense of rotation of the rotor (B).

4. Endothermic rotary engine with a double rotation center, according to one or more of paragraphs 1 to 3, wherein that the seat of discharging (11) of the stator or housing (A1), by means the seats (110*a*-110*b*) of a discharging valve (110), communicates also with other three inferior conducts (12*a*-12*b* and 12*c*), of which the inferior conduct sides (12*a* and 12*b*) are aligned and placed continuously with the superior conducts (11*a*, 11*b*) of the discharging seat (11) and are designed to discharge the incoming combustion gasses from the expansion room (1), while the central inferior pipe (12*c*) is continuously aligned with the superior pipe (11*c*) of the same discharging seat (11), through the seat (110*c*) of the valve (110), and is designed for the discharging of air and burned gas of the washing phase from the same expansion room (1).

5. Endothermic rotary engine with a double rotation center, perfected with bent walls and dischargings differentiated, according to one or more of paragraphs 1 to 4, wherein the inside surface of the stator compartment of expansion (1) presents a concave form (1*a*) having a profile that intersects with the convex surface (2*a*) of the stator compression compartment (2), the profile, the depth and the section of the arcuature (1*a*, 2*a*) is able to vary, in connection to the needed cylinder and corresponding and opposite to the arch (B1' and B2') of the rotating elements (B1, B2).

6. Endothermic rotary engine with a double rotation center, according to one or more of paragraphs 1 to 5, wherein the rotating element of expansion (B1) presents a side surface having a bent profile with convexity (B1') that traces, and reproduces, the profile of the concavity (1*a*) of the stator compartment of expansion (1) with the depth of its convexity (B1') such as not to interfere with the stator profile (2*a*), in its rotation within the compression compartment (2).

7. Endothermic rotary engine with a double rotation center, according to one or more of paragraphs 1 to 6, wherein the rotational element of compression (B2) has a side surface with a bent profile with cavity (B2') that traces, the profile of the side (2*a*) of the compression compartment (2).

8. Endothermic rotary engine with a double rotation center, according to one or more of paragraphs 6 and 7, wherein the cavity (B2') traces, the surface (2*a*) of the stator compression compartment (2), called cavity (B2') and cooperating with the concave surface (1*a*) to form the volumes of the expansion room (1);

9. Endothermic rotary engine with a double rotation center, according to one or more of paragraphs 1 to 8, wherein the expansion element (B1) presents a side bent surface (B1') with the same profile of the surface stator (1*a*) of the stator compartment (1) to form the volumes of the compression chamber (2) in competition with the stator profile (2*a*);

10. Endothermic rotary engine with a double rotation center, according to one or more of paragraphs 1 to 9, wherein, because of the correspondence between the profiles of the arcuature (1*a*, 2*a*, B1' and B2') and to the equality of the compression and of expansion, it is given back the possibility of a decrease of the distance (s), between the plans of intersection (x,y), realizing also equal values or like between the generator radii (r1) and (r2) of the respective compartments (1) and (2), with respect to a same housing (A1) having linear profiles;

11. Endothermic rotary engine with a double rotation center, according to one or more of paragraphs 1 to 10, wherein the depth and conformation of the arcuature (1*a*, 2*a*, B1' and B2'), determines an increase of the cylinder and power of an engine of equal obstacle and of identical wheelbase (s), or, to equality of obstacle and of rolled or power request, determines a solid reduction of the wheelbase (s) between the intersection plans (x, y).

12. Endothermic rotary engine with a double rotation center, according to one or more of paragraphs 1 to 11, wherein in the bent solution of the stator (A1), the will I compare between the volumes of compression (2) and of expansion (1) dall is determined' balance of the value of the respective rays generators (r2, r1).

13. Endothermic rotary engine with a double rotation center, perfected with bent walls and dischargings differentiated, according to one or more of paragraphs 1 to 12, wherein a suction valve (100) is located in the Stator compartment (10) and contains a cylindrical groove (100*a*) to permit and moderate the inlet stroke and the passage of the outside air into the stator compartment (2) and (1), through the stator conduct (10*a*).

14. Endothermic rotary engine with a double rotation center, according to one or more of paragraphs 1 to 13, wherein a discharging valve (110) located in the stator compartment (11) and is provided of two side grooves (110*a*, 110*b*) that, with the rotation of the valve (110), are fit to align itself to the superior stator conducts (11*a*, 11*b*) and to the inferior stator conducts (12*a*, 12*b*), to allow the discharging of the only combustion gas to exit from the expansion compartment (1).

15. Endothermic rotary engine with a double rotation center, according to one or more of paragraphs 1 to 14, wherein the discharging valve (110) is provided with a central groove (110*c*) that, with the rotation of the named valve (110) within the stator compartment (11), is fit to align itself to the carried out superior stator (11*c*) and to the inferior pipe (12*c*), to discharge the mixture of washing gases to exit from the expansion compartment (1), before a new thermodynamic cycle to occur in the same engine.

16. Endothermic rotary engine with a double rotation center, according to one or more of paragraphs 1 to 15, characterized wherein the exhaust strokes of the burned gas and of the mixture of washing arc differentiated between them by the presence, in proximity of the final part of the expansion room (1) and of its intersection with its counter imposed suction room (2) of the stator or housing (A), of two different conducts (11*a*, 11*b*), for the discharging of the burned gas and of a pipe (11*c*), for the discharging of the mixture of washing, being their opening and moderate closing from the presence of the valve (110).

17. Endothermic rotary engine with a double rotation center, according to one or more of paragraphs 1 to 16, wherein the discharging of the burned gases precedes the discharging of the mixture of washing, with the possibility of temporary co-occurrence of two phases, for the passing time of some mixture of washing within the expansion room (1), such a powerful exhaust stroke would also allow for possible side opening (9) of the stator lids (A2-A3).

18. Endothermic rotary engine with a double rotation center according to one or more of paragraphs 1 to 17, wherein the discharging of the burned gas and of the mixture of gases can also occur with other types of valves (110), operating also singularly and with respective compartment (110*a*, 110*b*) and (110*c*), alone for the discharging of the combustion gases and alone for the mixture of the gases, working with contemporary or alternate applications of the valves (110) also on the lids (A2-A3) and, however following the start of differentiation of the attainable dischargings with its described temporal sequentiality of two phases.

19. Endothermic rotary engine with a double rotation center, according to one or more of paragraphs 1 to 18, wherein the stator or housing (A1) can be realized in two bodies (AT) and (A1") with preferable junction along the profile of the intersection between the cavity (1*a*), that is all included in the body (A1'), and the convexity (2*a*), that remains all included in the body (A1").

The invention claimed is:

1. A rotary spark ignition engine with a double rotation center, comprising:

a stator with a stator central body having a compartment, a first side cover, and a second side cover;

wherein the compartment further includes:

an expansion compartment, a compression compartment, and a combustion chamber at an upper portion of the compartment, a rotor with an expansion rotating element, a compressing rotating element and a hinging linear element interposed between the expansion rotating element and the compression rotating element;

wherein the rotor is arranged in the compartment of the stator central body;

wherein the expansion compartment comprises a concave inner surface and the compression compartment comprises a convex inner surface;

wherein the expansion rotating element comprises a convex outer side surface that corresponds to the concave inner surface of the expansion compartment and the compression rotating element comprises a concave outer side surface that corresponds to the convex inner surface of the compression compartment;

wherein the stator central body comprises a cylindrical suction seat communicating with the compartment for introducing air into the compartment and a cylindrical discharge seat communicating with the compartment for discharging a combustion gas; and wherein the compartment of the stator comprises one or more seats for spark plugs that ignite the combustion gas located in the combustion chamber.

2. The spark ignition engine according to claim 1, wherein the concave and convex surfaces are implemented with an arch profile.

3. The spark ignition engine according to claim 1, wherein the concave and convex surfaces have identical profile and depth values.

4. The spark ignition engine according to claim 1, wherein the cylindrical suction seat and the cylindrical discharge seat are arranged between the concave inner surface and the convex inner surface.

5. The spark ignition engine according to claim 1, wherein the cylindrical discharge seat comprises a slot extending over a width of the stator central body for communicating with the compartment.

6. The spark ignition engine according to claim 1, wherein the cylindrical discharge seat comprises a plurality of upper side ducts for communicating with the expansion compartment.

7. The spark ignition engine according to claim 6, wherein the plurality of upper side ducts are formed as two upper side ducts and a central duct, the central duct displaced from the two upper side ducts along an inner side surface of the compartment.

8. The spark ignition engine according to claim 6, wherein the cylindrical discharge seat comprises a plurality of lower side ducts.

9. The spark ignition engine according to claim 8, wherein the plurality of lower side ducts are aligned with the plurality of upper side ducts.

* * * * *